US006000929A

United States Patent [19]

Izumo et al.

[11] Patent Number: 6,000,929

[45] Date of Patent: Dec. 14, 1999

[54] ROTARY DISTRIBUTION VALVE, AND REGENERATIVE COMBUSTION APPARATUS AND REGENERATIVE HEAT EXCHANGER USING SAME

[75] Inventors: Masanori Izumo, Neyagawa; Morimasa Watanabe; Hiroshi Mori, both of Settsu, all of Japan

[73] Assignee: Daikin Industries, Ltd., Osaka, Japan

[21] Appl. No.: 08/545,867

[22] PCT Filed: Mar. 10, 1995

[86] PCT No.: PCT/JP95/00409

§ 371 Date: Feb. 20, 1996

§ 102(e) Date: Feb. 20, 1996

[87] PCT Pub. No.: WO95/24593

PCT Pub. Date: Sep. 14, 1995

[30] Foreign Application Priority Data

Mar. 11, 1994 [JP] Japan ..... 6-041590
May 11, 1994 [JP] Japan ..... 6-097701

[51] Int. Cl.[6] ..... F23D 14/00; F01N 3/10

[52] U.S. Cl. ..... 431/7; 431/11; 431/170; 431/215; 422/182; 137/625.46

[58] Field of Search ..... 431/7, 11, 215, 431/170; 165/4; 110/212, 213, 214, 211; 422/182

[56] References Cited

U.S. PATENT DOCUMENTS 4,126,419 11/1978 Katabuchi et al. ..... 422/109
5,016,657 5/1991 Thomason .
5,460,789 10/1995 Wilhelm ..... 431/7
5,562,442 10/1996 Wilhelm ..... 431/5

FOREIGN PATENT DOCUMENTS 43 01 748 7/1994 Germany .
51-102278 8/1976 Japan .
63-180779 7/1988 Japan .
791222 2/1958 United Kingdom .

*Primary Examiner*—Carl D. Price
*Attorney, Agent, or Firm*—Wenderoth, Lind & Ponack, L.L.P.

[57] ABSTRACT

A continuous operation and efficient device used for heat decomposition and purification of a malodorous objective gas is disclosed. The device has large-sized and heavy heat reserving materials in a stationary condition. The objective gas is supplied to a chamber of a rotary distribution valve. From there, the gas is conducted from a guide space through first moving valve ports of a moving valve member and a stationary valve port of a stationary valve member to a plurality of passages. The passages separated by partition plates in a housing and contain therein the heat reserving material (heat exchanger column), a pretreatment material and a catalyst. The gas undergoes endothermic reaction for heat decomposition of the malodorous substances by means of the catalyst and a burner. The objective gas then has its heat exchanged or temperature reduced through the heat reserve material, so that a purified gas is expelled from the stationary valve port and second moving valve ports through a chamber. A third moving valve port is provided to prevent the gas being treated from being mixed with the purified gas. A change-over section is provided to instantaneously perform change-over of gas flows through the plurality of passages thereby improving efficiency of operation.

32 Claims, 20 Drawing Sheets

ROTARY DISTRIBUTION VALVE, AND REGENERATIVE COMBUSTION APPARATUS AND REGENERATIVE HEAT EXCHANGER USING SAME

FIELD OF THE INVENTION

The present invention relates to a rotary distribution valve for changing the flow direction and guiding a fluid such as gas. The invention also relates to a regenerative combustion apparatus using the rotary distribution valve, and its operating method. Finally, the invention relates regenerative heat exchanger using the rotary distribution valve.

BACKGROUND ART

A direct combustion apparatus hitherto employed for removing malodorous substances discharged from a paint plant and other various plants is designed to heat an objective gas to about 800° C., oxidize the malodorous substances, and decompose into odorless carbon dioxide and water. It is known as a deodorizing apparatus and has a wide scope of applications. In addition, it is capable of treating all malodorous substances that are oxidized and decomposed at a high temperature. A drawback of this direct combustion apparatus is its high fuel cost. In other words, the combustion heat of the malodorous substances is lowered as the concentration of the malodorous substances is lowered, which leads to increase of the fuel amount, thereby increasing the cost.

A prior art device which uses a reduced fuel amount and has an exceptional heat recovery rate is disclosed in FIG. 22. First, second, and third columns 1, 2, 3 filled with a heat reserve material such as ceramics are provided. Burners 4, 5 are disposed so that the temperature of the top of each column reaches about 800° C. The objective gas containing malodorous substances is guided into a duct 6, which is linked to the lower part of each column 1, 2, 3 through valves 7, 8, 9. The gas purified through valves 10, 11, 12 is discharged through a duct 13.

During operation, the objective gas from the duct 6 is raised, for example, from the lower part of the second column 2 through the valve 8, and is heat-exchanged. The malodorous substances are oxidized and decomposed by the burner 5. A heat reserve material 14 in the third column 3 is heated to reserve heat. The purified gas is discharged from the duct 13 through the valve 12, and exhausted to the atmosphere. The valves are changed over by a timer, and purging air is supplied from a duct 15 into the lower part of the second column 2 to move the malodorous gas in the second column 2 into the first column 1. The objective gas to be processed next is guided into the lower part of the third column 3 through the valve 9 from the duct 6, and is heated by the heat reserve material 14. The malodorous substances are oxidized and decomposed by the burner 4. The heat reserve material in the first column 1 is heated to exchange heat, and the purified gas is moved into the duct 13. Afterwards, the purging air is further supplied into the lower part of the third column 3 from the duct 15, and is conducted into the second column 2 through the burner 5. The objective gas is supplied into the lower part of the first column 1 through the valve 7 from the duct 6, and heated by the heat reserve material. The malodorous substances are oxidized and decomposed by the burner 4, and the gas purified through the valve 11 from the second column 2 is discharged from the duct 13 together with the air for purge. In this way, sequentially in time by the timer, the objective gas rises through the first to third columns 1, 2, 3, and absorbs the heat from the heat from the heat reserve material 14. The gas heated by the burners 4, 5 descends through the first, second and third columns 1, 2, 3 to heat the heat reserve material 14, so that the heat recovery rate may be enhanced greatly.

A problem of the prior art shown in FIG. 22 is that it requires a total of three large-sized columns 1, 2, 3 for the purpose of purging. Before changing from the heat absorption process of the objective gas into the heat release process, the malodorous gas remaining in the columns 1, 2, 3 without being decomposed must be purged. Although the amount of air necessary for this purge is substantially smaller as compared with the flow rate of the objective gas, the prior art device shown in FIG. 22 requires the columns to have the same volume as the columns for heat absorption-release, and the facility cost is high, and a wider area for installation is needed. Moreover, it requires a total of six changeover valves 7, 8, 9, 10, 11, 12, and also three purging changeover valves. Therefore, the construction is complicated and expensive.

Moreover, in the prior art device shown in FIG. 22, the changeover operation of the valves 7, 8, 9, 10, 11, 12 is a so-called semi-batch operation, and the changeover operation is done, generally, every two minutes or so. The required amount of heat reserve material is determined by this changeover time. Thus, a changeover operation every one minute requires about half the two-minute amount, and the required amount of heat reserve material is about one-quarter the two-minute amount when changing over every 30 seconds. But the prior art device shown in FIG. 22 requires an operation time dependent upon the valves 7, 8, 9, 10, 11, 12, and the time required for purging a massive volume of air is long. Hence, it is difficult to shorten the changeover time of the valves 7, 8, 9, 10, 11, 12, and as mentioned above, the required amount of the heat reserve material increases.

FIG. 23 shows other prior art device which has an exceptional heat recovery efficiency and is capable of saving the fuel consumption for the purpose of downsizing the constitution. In this prior art device, the objective gas containing malodorous substances is supplied from a duct 17, and is moved into an upper space 20 of a housing 19 via a changeover valve 18. As it flows through the heat reserve material 21, it is heated by the heat reserve material 21, and is further heated by an electric heater 22 to about 1000° C. The heat is released to a heat reserve material 23 beneath, and as a result heat is accumulated in the heat reserve material 23. The gas is then discharged through a changeover valve 18 and a duct 25 from a lower space 24. Then the changeover valve 18 is changed over, and the objective gas from the duct 17 passes through the space 24. The gas is next heated by the heat reserve material 23, and is further heated by the electric heater 22. The heat is then released to the heat reserve material 21 thereby accumulating heat. Finally, the gas is discharged from the duct 25 through the changeover valve 18 from the space 20. Such operation is then repeated.

In the prior art shown in FIG. 23, immediately after changeover operation of the changeover valve 18, purging is not carried out, and hence the objective gas containing malodorous substances is partly discharged through the duct 25. A different prior art device for solving this problem is disclosed in FIG. 24. In this prior art device, the corresponding parts similar to those of the prior art device shown in FIG. 23 are denoted with the same reference numerals. This prior art device has further changeover valves 27, 28, and also has a purge tank 30 communicating with the atmosphere.

In this prior art device, the objective gas containing malodorous substances is passed through the changeover valve 18 from the duct 17, and is heated by the heat reserve material 21 from the space 20 in the housing 19. The gas is further heated by the electric heater 22, and the heat is reserved in the heat reserve material 23. Then, a purified gas is discharged through the valve 27 from the changeover valve 18 and the duct 25. At this time, the changeover valve 28 is closed. Immediately after the changeover valve 18 is changed over, the changeover valve 27 is closed and the changeover valve 28 is opened. Gas is moved from the duct 17 through the changeover valve 18 and from the space 24 in the housing 19 through the space 20. In addition, gas is moved through the changeover valves 18, 28, and then stored in the tank 30. After storing a necessary amount for purge, the changeover valve 28 is closed, the changeover valve 27 is opened, and the exhaust gas is exhausted through the changeover valve 27. The air containing malodorous substances stored in the tank 30 immediately after the changeover is later passed gradually into the duct 17 through the duct 31, and is mixed into the objective gas.

This prior art device shown in FIG. 24 has problems that the large column tank 30 for purge is required, time for changeover operation of the changeover valves 18, 27, and 28 is necessary, and a large amount of heat reserve material is required. Such problems are the same as experienced in the prior art mentioned in FIG. 22.

A different prior art device is disclosed in U.S. Pat. No. 5,016,547. In this prior art, heat reserve materials are disposed in plural segments partitioned in a housing in the peripheral direction. A changeover valve having a valve disc disposed beneath the housing is rotated. The objective gas is then elevated and heated by the heat reserve materials, and flammable components of the objective gas are burnt in a combustion chamber above the housing. A purified gas containing no flammable component passes through the heat reserve materials and descends while heating the heat reserve materials. The purified gas is discharged outside through the changeover valve, and the changeover valve sequentially changes over each of such segments in the peripheral direction. Such fundamental constitution is similar to the principle of the present invention, except that in the prior art, a pair of purge gas passages are formed at positions deviated from each other by 180 degrees in the peripheral direction to prevent the objective gas remaining in the segment from entering into the purified gas. The prior art device thus prevents objective gas from being discharged at the time the segments of the heat reserve materials are changed over by the changeover valve so that the purified gas may descend.

A problem of this prior art is that a pair of purge gas passages are formed, thereby decreasing the heat reserve materials, i.e. the effective volume used to treat the objective gas and produce clean gas. Moreover, the structure of the changeover valve for forming the two purge gas passages is complicated. Furthermore, since gas is supplied into the pair of purging gas passages, the required flow rate of purge gas is increased.

SUMMARY OF THE INVENTION

It is hence an object of the invention to provide a regenerative combustion apparatus and its operating method which are capable of enhancing notably the heat recovery efficiency, decreasing the fuel consumption by lowering the oxidation reaction temperature, and reducing its size. It is also an object to provide a regenerative heat exchanger.

It is another object of the invention to provide a rotary distribution valve to be used preferably in such regenerative combustion apparatus and regenerative heat exchanger.

The invention provides a rotary distribution valve (a changeover valve) including a valve box, a passage forming device, a valve disc, a guide space, and a communicating passage.

The valve box includes a pair of chambers formed in an axial direction. Each chamber is provided with a connection port respectively.

The passage forming device is for forming plural (for example, eight in an embodiment described below) passages each formed in a stationary valve port. The passage forming device is fixed at one end of the valve box in the axial direction, and has the plurality of stationary valve ports located at intervals in the peripheral direction around the axial line.

The valve disc is accommodated in the valve box so as to be rotated about the axial line.

Furthermore, first and second moving valve ports are formed at positions facing the first chamber on one end in the axial direction of the valve box at intervals in the peripheral direction about the axial line. A third moving valve port is formed either between the first and second moving valve ports or between the first and second moving valve ports along the peripheral direction.

The guide space is for communicating the second chamber with the first moving valve ports and is formed by partition walls provided in the first chamber. The guide space is partitioned from the first chamber, and the first chamber is in communication with the second moving valve ports.

The communicating passage communicates with the third moving valve ports and is formed by an auxiliary partition wall.

The valve disc has a changeover part expanding in the peripheral direction between the first and second moving valve ports along the peripheral direction so that at least one of the stationary valve ports may be changed over distinctively.

The first moving valve ports may be formed continuously in the peripheral direction, or the second moving valve ports may be formed continuously in the peripheral direction. In an embodiment mentioned below, the first moving valve ports are separated only for the purpose of reinforcement. Similarly, the second moving valve ports are separated only for the purpose of reinforcement, but they may also be formed continuously in the peripheral direction as mentioned above.

Moreover, according to the invention, the valve disc includes a rotary shaft and a moving valve member. The rotary shaft rotates about the axial line. The moving valve member is fixed to the rotary shaft vertically at one end in the axial direction of the valve box. The moving valve member includes the first, second, and third moving valve ports.

The passage forming device includes a stationary valve member and a plural passage forming device. The stationary valve member is fixed to the valve box opposite to the moving valve member. The stationary valve member includes the stationary valve ports overlaying the first, second, and third moving valve ports. The plural passages forming device individually communicates with the stationary valve ports of the stationary valve member.

Also in the invention, the valve disc has a rotary shaft rotating about the axial line. The rotary shaft has a shaft hole.

The communicating passage communicates with the shaft hole, and the rotary shaft is provided with a rotary tube joint to be connected to the shaft hole.

Also in the invention, the valve disc has a moving valve member which is vertical to the axial line, and the moving valve member includes the first, second, and third moving valve ports, a changeover part, and seal members. The seal members slide on the opposite surface of the stationary valve member and extend in the radial direction among the first, second, and third moving valve ports.

Also in the invention, a first angle in the peripheral direction of the pair of seal members at both sides in the peripheral direction of the third moving valve port is $\theta$ 1. Each stationary valve port is formed by a second angle $\theta$ 2 in the peripheral direction. The interval of the mutually adjacent stationary valve ports is formed by a third angle $\theta$ 3 in the peripheral direction. These angles have the following relation:

$$\theta 2+\theta 3 \geqq \theta 1 \geqq \theta 2, \text{ and}$$

$$\theta 3 \geqq \theta 2.$$

Also in the invention, the relation of $\theta 3 \geqq \theta 2$ is satisfied.

Also in the invention, a pair of auxiliary seal members are provided at both sides in the peripheral direction of the seal members and the angle $\theta$ 6 of these auxiliary seal members has the relation of:

$$\theta 2+2\cdot\theta 3 \geqq \theta 6 \geqq \theta 2.$$

Also in the invention, the seal members provided between the first and second moving valve holes along the peripheral direction, out of the seal members are disposed in the changeover part at an angle $\theta$ 4, which has the relation of:

$$\theta 4 \approx \theta 2.$$

The invention also provides a regenerative combustion apparatus including a housing, a heat exchanger column (heat reserve material) accommodated in the housing, a catalyst for burning the objective gas provided above the heat exchanger column in the housing, partition boards extending vertically in the housing for forming plural passages by partitioning the heat exchanger column and the catalyst at intervals in the peripheral direction, and communicating with a common space in the upper part of the housing, and a rotary distribution valve provided beneath the housing.

The rotary distribution valve includes: a valve box, a passage forming device, and a valve disc. The valve box includes a pair of chambers in the axial direction. Each chamber includes a connection port respectively.

The passage forming device is for forming plural (for example, eight in an embodiment described below) passages in every stationary valve port. The passage forming device is fixed at one end in the axial direction of the valve box and includes the plurality of stationary valve ports at intervals in the peripheral direction around the axial line.

The valve disc is accommodated in the valve box so as to be rotated about the axial line.

Furthermore, the first and second moving valve ports are formed at positions facing the first chamber on an end in the axial direction of the valve box at intervals in the peripheral direction about the axial line. A third moving valve port is formed either between the first and second moving valve ports or between the first and second moving valve ports along the peripheral direction.

A guide space for communicating the second chamber with the first moving valve ports is formed by partition walls provided in the first chamber. The guide space is partitioned from the first chamber and the first chamber is in communication with the second moving valve ports.

A communicating passage communicates with the third moving valve ports and is formed by an auxiliary partition wall.

The valve disc has a changeover part extending in the peripheral direction between the first and second moving valve ports along the peripheral direction so that at least one of the stationary valve ports may be distinguished.

The lower part of the rotary distribution valve is fixed to a stationary valve member. The objective gas is supplied into either one of the chambers and purified gas is moved in from the remaining chamber. A clean purging gas is supplied into the communicating passage in the same flow direction as that of the objective gas. The valve disc is rotated by a rotation drive source in a direction of the purging gas being changed over and passed, in the plural passages through which the objective gas passes.

Also in the invention, a heating device is provided in the upper space of the housing. A space partition wall for forming a space by being fixed in the upper part of the housing, is provided. Communicating holes for individually communicating with the plural passages partitioned by the partition boards are formed in the space partition wall. The communicating holes are disposed above and at a clearance from the upper part of a catalyst and are formed by a porous plate having multiple discrete pores.

Also in the invention, a pretreatment material is interposed between the heat exchanger column and the catalyst in order to remove the catalyst deteriorating substances contained in the objective gas.

The catalyst is composed of a honeycomb-base material, and the pretreatment material whose specific heat is about 0.1 kcal/° C. or less is used.

Also in the invention, the pretreatment material is composed of a corrugated base.

Also in the invention, a pretreatment material is interposed between the heat exchanger column and the catalyst in order to remove the catalyst deteriorating substances contained in the objective gas.

The catalyst is mainly composed of a foamed metal material and is combined with the pretreatment material.

Also in the invention, means for controlling the heating device is provided so that the temperature of the pretreatment material may be 250° C. or more.

Moreover, according to the invention, the valve disc includes: a rotary shaft rotating about the axial line; and a moving valve member fixed to the rotary shaft vertically at one end in the axial direction of the valve box. The moving valve member includes the first, second, and third moving valve ports.

The passage forming device includes a stationary valve member and a plural passage forming device. The stationary valve member is fixed to the valve box opposite the moving valve member. The stationary valve member includes the stationary valve ports overlaying on the first, second and third moving ports. The plural passages forming device individually communicates with the stationary valve ports of the stationary valve member.

Also in the invention, the valve disc has a rotary shaft rotating about the axial line. The rotary shaft has a shaft hole. The communicating passage communicates with the shaft hole. The rotary shaft is provided with a rotary tube joint to be connected to the shaft hole.

Also in the invention, the valve disc has a moving valve member which is vertical to the axial line. The moving valve member includes: the first, second, and third moving valve ports, the changeover part, and seal members sliding on the opposite surface of the stationary valve member. The seal members extend in the radial direction among the first, second, and third moving valve ports.

Also in the invention, the first angle in the peripheral direction of the pair of seal members at both sides in the peripheral direction of the third moving valve port is $\theta 1$. Each stationary valve port is formed by a second angle $\theta 2$ in the peripheral direction. The interval of the mutually adjacent stationary valve ports is formed by a third angle $\theta 3$ in the peripheral direction. These angles have the relation of:

$$\theta 2+\theta 3 \geqq \theta 1 \geqq \theta 2, \text{ and}$$

$$\theta 3 \geqq \theta 2.$$

Also in the invention, the relation of $\theta 3 \geqq \theta 2$ is satisfied.

Also in the invention, a pair of auxiliary seal members are provided at both sides in the peripheral direction of the seal members.

The angle $\theta 6$ of these auxiliary seal members is selected to satisfy the relation of:

$$\theta 2+2\cdot\theta 3 \geqq \theta 6.$$

Also in the invention, the seal members provided between the first and second moving valve holes along the peripheral direction, out of the seal members are disposed in the changeover part at an angle of $\theta 4$, which is selected in the relation of $$\theta 4 \approx \theta 2,$$

The invention moreover provides an operating method of a regenerative combustion apparatus. The method includes: preparing a regenerative combustion apparatus. The regenerative combustion apparatus including: a housing, a heat exchanger column accommodated in the housing, a catalyst, partition bonds, and a rotary distribution valve. The catalyst is provided above the heat exchanger column in the housing and is for burning the objective gas. The partition boards extend vertically in the housing and form passages by partitioning the heat exchanger column and catalyst at intervals in the peripheral direction, and by communicating with a common space in the upper part of the housing. The rotary distribution valve is provided beneath the housing.

The rotary distribution valve includes: a valve box, a passage forming device, and a valve disc. The valve box includes a pair of chambers formed in the axial direction. Each chamber is provided with a connection port respectively.

The passage forming device forms plural (for example, eight in an embodiment described below) passages, one in every stationary valve port 82. The passage forming device is fixed at one end in the axial direction of the valve box and has the plurality of stationary valve ports positioned at intervals in the peripheral direction around the axial line.

The first and second moving valve ports are formed at positions facing the first chamber at the end in the axial direction of the valve box at intervals in the peripheral direction about the axial line. A third moving valve port is formed either between the first and second moving valve ports or between the first and second moving valve ports along the peripheral direction.

A guide space for communicating the other chamber with the first moving valve ports is formed by partition walls provided in the first chamber. The guide space is partitioned from the first chamber, and the first chamber is in communication with the second moving valve ports.

A communicating passage is in communication with the third moving valve ports and is formed by an auxiliary partition wall.

The valve disc has a changeover part extending in the peripheral direction between the first and second moving valve ports along the peripheral direction, so that at least one of the stationary valve ports may be closed.

The lower part of the rotary distribution valve is fixed to a stationary valve member 71. The objective gas is supplied into either one of the chambers and purified gas is conducted in from the remaining chamber. A clean purging gas is supplied into the communicating passage in the same flow direction as the objective gas. The valve disc is rotated by a rotation drive source in a direction of the purging gas being changed over and passed, in the passages through which the objective gas passes.

The heating means is provided in the upper space of the housing. A space partition wall for forming the space by being fixed in the upper part of the housing is provided. Communicating holes for individually communicating with each passage partitioned by the partition boards are formed in the space partition wall. The communicating holes are disposed above and at a clearance from the upper part of the catalyst and are formed by a porous plate having multiple discrete pores. The objective gas passes through the communicating hole at about 5 to 20 m/sec.

The invention further provides a regenerative heat exchanger including: a housing, a heat exchanger column accommodated in the housing, partition boards and first and second rotary distribution valves. The partition boards extend vertically in the housing and form passages by partitioning the heat exchanger column at intervals in the peripheral direction. The first and second rotary distribution valves are provided above and beneath the housing.

Each one of the rotary distribution valves includes: a valve box, a passage forming device, and a valve disc. The valve box includes a pair of chambers positioned in the axial direction. Each chamber is provided with a connection port respectively.

The passage forming device forms passages in every stationary valve port. The passage forming device is fixed at one end of the valve box in the axial direction, and includes the plurality of stationary valve ports at intervals in the peripheral direction around the axial line. The valve disc is accommodated in the valve box so as to be rotated about the axial line.

The first and second moving valve ports are formed at positions facing the first chamber on the end in the axial direction of the valve box at intervals in the peripheral direction about the axial line. A third moving valve port is formed either between the first and second moving valve ports or between the first and second moving valve ports along the peripheral direction.

A guide space for communicating the other chamber with the first moving valve ports is formed by partition walls provided in the first chamber. The guide space is partitioned from the first chamber and the first chamber is communicated with the second moving valve ports.

A communicating passage communicates with the third moving valve ports and is formed by an auxiliary partition wall.

The valve disc has a changeover part extending in the peripheral direction between the first and second moving valve ports along the peripheral direction so that at least one of the stationary valve ports may be closed.

Both ends of the partition boards are fixed to stationary valve members.

Rotary shafts of the rotary distribution valves are driven in cooperation.

High pressure gas is supplied into either chamber of the first rotary distribution valve and is conducted into either chamber of the second rotary distribution valve through a heat exchanger column (a heat reserve material).

Low temperature gas is supplied into the remaining chamber of either the first or second rotary distribution valve and is conducted into the remaining chamber of the other rotary distribution valve.

In the rotary distribution valve according to the invention, a pair of chambers are formed in the axial direction in the valve box. When fluid such as the objective gas is supplied, for example, from the connection port of the chamber, the gas is conducted from the guide space partitioned by the partition wall of the valve disc, through the first moving valve ports and further through the passages of each stationary valve port through the stationary valve port of the passage forming device.

On the other hand, the fluid such as clean gas from a passage positioned so as to communicate with the other stationary valve port, is conducted from the other stationary valve port through the second moving valve ports of the moving valve member and from the one chamber of the valve box through the connection port of the one chamber. In this way, by rotating the valve disc about its axial line, the passage of the fluid can be sequentially changed over by sequentially changing over the plural stationary valve ports formed in the passage forming means.

Moreover, in the rotary distribution valve according to the invention, in the valve disc the third moving valve port is formed either between the first and second moving valve ports or between the first and second moving valve ports along the peripheral direction. The communicating passage communicates with the third moving valve port through the auxiliary partition wall. The fluid, such as purging air guided into the shaft hole through the rotary tube joint can be passed through the stationary valve port of the passage forming means through the third moving valve port from the communicating passage formed by the auxiliary partition wall.

In particular, in the rotary distribution valve according to the invention, the third moving valve port is thus formed either between the first and second moving valve ports or between the first and second moving valve ports along the peripheral direction, The changeover part is formed between the other first and second moving valve ports along the peripheral direction. The changeover part extends in the peripheral direction, so that at least one of the plural stationary valve ports can be closed. Therefore during rotation of the valve disc it is only for a short time that the rotary distribution valve of the valve disc closes the fixed valve port hermetically. As the peripheral positions of the changeover part and stationary valve port are deviated from each other, the fluid such as the objective gas flows through the first moving valve ports while the fluid such as purified gas flows through the second moving valve ports flows into the passages individually communicating with the closed stationary valve port. Thus, the fluid such as gas is almost always flowing in the plural passages formed in the passage forming device. That is, none of the passages is at rest, so that the operation efficiency is enhanced. This is particularly advantageous when the invention is applied to the regenerative combustion apparatus or regenerative heat exchanger and so forth as described below in relation to the passage forming device.

Further according to the invention, the second angle θ 2 in the peripheral direction of the stationary valve port in the rotary distribution valve is equal to or less than the first angle θ 1 in the peripheral direction of the seal members at both sides in the peripheral direction of the third moving valve port. θ 2 is also equal to or less than the third angle θ 3 which is the interval in the peripheral direction of the mutually adjacent stationary valve ports so that mixing of the objective gas, purging air, and purified gas can be eliminated or sufficiently decreased.

The first angle θ 1 is defined to be equal to or less than the third angle θ 3. Hence the third moving valve port does not unexpectedly communicate with the two stationary valve ports which are adjacent to the stationary valve port communicating with the third moving valve port. Therefore, the connection is airtight.

Also according to the invention, the second angle θ 2 is less than the third angle θ 3. In addition, the porosity of the stationary valve member is less than 50%, so that leakage of the three gases may be prevented.

According to the invention, the peripheral angle θ 5 of the pair of auxiliary seal members, disposed at both sides in the peripheral direction outside the pair of seal members disposed at both sides of the third moving valve port, is defined to be equal to or greater than the angle θ 2 in the peripheral direction of the stationary valve port. θ 5 is also defined to be equal or less than θ 2+θ 3. Therefore the third moving valve port is prevented from communicating with the two stationary valve ports which are adjacent to both sides of the one stationary valve port communicating with the third moving valve port. Hence, the connection is airtight.

Further according to the invention, the connection of one stationary valve port is rendered airtight by means of the seal members of the changeover part. In addition, the connection is established without communicating with the first and second moving valve ports adjacent to the changeover part, and is thus airtight. In particular, by selecting the angle θ 4 of the seal members of the changeover part to be nearly equal to the angle θ 2 of the stationary valve port, one stationary valve port closed by the changeover part may be closed for a very short time during the rotation of the valve disc. Therefore the first, second, and third moving valve ports will almost always communicate with the passages of each one of the stationary valve ports. Hence the operation efficiency of the passages may be enhanced.

To prevent leak of gas, aside from the seal members at both sides in the peripheral direction of the third moving valve port and the other seal members the changeover part as the so-called changeover zone, and seal members for the changeover parts are further provided, and therefore leakage of three gases can be prevented.

According to the invention, the rotary distribution valve above mentioned is provided beneath the housing accommodating the heat exchanger column. The catalyst for burning, oxidizing and decomposing the malodorous substances in the objective gas is disposed above the heat exchanger column in the housing. The passages containing the heat exchanger column and catalysts are formed in every stationary valve port of the stationary valve member by the partition boards in the housing. By rotating and driving the rotary shaft, the objective gas containing the malodorous substances is supplied into the other chamber of the valve box. The heat reserved in the heat exchanger column is absorbed in the objective gas. The malodorous substances are oxidized and decomposed by the catalyst, and more preferably, the oxidation and decomposition may be facilitated by heating by the heating device such as a burner or an electric heater. The purifier gas at high temperature is conducted into the heat exchanger column to heat the heat exchanger column. The purified gas is cooled, and discharged from one chamber, thereby enabling continuous gas treatment.

In the communicating passage, purging gas is supplied in the same flow direction as the objective gas (for example, upward in the embodiment described below). The valve disc is rotated by rotary drive sources and its rotating direction is determined by the direction of the purging gas being changed over and passed in the passages in which the objective gas flows. Therefore the objective gas is flowing in the passages and when the purging gas is supplied next in the same flow direction as the objective gas, the objective gas flows in the changed passages without leaving any remainder, thereby preventing the objective gas in the passages from mixing into the purified gas.

When the elements are arranged so that the objective gas is supplied into the one chamber while purified gas is discharged from the other chamber the rotating direction of the valve disc is reverse to the above rotating direction. With any rotating direction, the rotating direction of the valve disc is so that, after the objective gas has flowed into the passage, the purging gas is changed over to pass, and is followed by the purified gas.

High temperature gas does not come in contact with the rotary distribution valve, and hence the manufacture of the rotary distribution valve is easy.

Moreover, for example, by supplying purging air through the communicating passage from the shaft hole through the rotary tube joint the objective gas in the passage containing the heat exchanger column and catalyst in which the objective gas is remaining can be purged by a small amount of gas such as purging air, and be purified. Therefore, only a small region is needed in the peripheral direction of the third moving valve port for purge. Hence the required amount of heat reserve material is less, and the structure may be reduced in size.

In the regenerative catalytic combustion apparatus of the invention, the space partition wall is fixed in the upper part of the housing, thereby forming the space common to the plural passages. The heating device is provided in the space as mentioned above. The communicating holes for individually communicating with the passages partitioned by the partition boards are further formed in the space partition wall. Thus the climbing objective gas and purging air through the passages are conducted securely into the space. Therefore the objective gas and purging air are prevented from being short-circuited and short-passed to mix with the purified gas. The purified gas discharged from this space is discharged as a descending flow of uniform temperature distribution by the heating means. Consequently, the malodorous substances in the objective gas are oxidized and decomposed securely.

According to the invention, the communicating holes are disposed above and at a clearance from the upper part of the catalyst and are realized by a porous plate such as punching metal, and multiple pores are formed discretely. Therefore a proper pressure loss is caused when the objective gas and purging gas flow into the common space. The objective gas and purging gas flow through the space at about 5 to 20 m/sec, and the distribution of the flow velocity is nearly uniform in each of the multiple pores. Hence the gas is mixed sufficiently in the space and mixing and heating of gas and oxidation and decomposition of malodorous substances may be accomplished by the heating means.

If the flow velocity of the objective gas and purging gas into the space is less than about 5 m/sec, gas mixing in the space will be insufficient, and the distribution of gas temperature when discharged as purified gas from the space will be increased. That is, the temperature difference between maximum temperature and minimum temperature of the gas discharged from the space will be too large. If the flow velocity exceeds about 20 m/sec, on the other hand, the pressure loss in the communicating holes of multiple pores suddenly becomes excessive, and larger power is required for the fan to force out the objective gas and purging gas.

Moreover, in the regenerative catalytic combustion apparatus of the invention, between the heat exchanger column and the catalysts, a pretreatment material for removing the catalyst deteriorating substances contained in the objective gas by oxidizing or other processes is interposed. The catalyst is in a structure having a honeycomb base material, that is, a honeycomb carrier. The pretreatment material is set at a specific heat of about 0.1 kcal/° C.-liter or less. Therefore when the temperature in the space provided with the heating means is kept at, for example, around 350° C., the temperature of the pretreatment material and catalyst contacting with the objective gas and purging gas can be maintained at a temperature efficient for their action, for example, above 250° C. or preferably over 300° C.

The catalyst of honeycomb base, that is, the honeycomb catalyst has a space velocity (SV) valve of 40000, and at this time the specific heat of the pretreatment material is about 0.1 kcal/° C.-liter. By using the pretreatment material mainly composed of, for example, the corrugated base, its heat capacity can be decreased. Therefore, the purified gas from the space heated by the heating means is prevented from decreasing in temperature as the heat is absorbed by the catalyst and pretreatment material. The objective gas can be treated while keeping above a temperature suited to achieve a sufficient action of the catalyst and pretreatment material.

Moreover, according to the invention, by using the catalyst mainly composed of foamed metal, and the pretreatment material in corrugated or honeycomb structure, the catalyst made of the foamed metal has a SV value of 60000. As the SV value increases, the filling amount of the catalyst decreases, and the heating action decreases as well. Therefore the objective gas can be treated, while the temperature of the catalyst and pretreatment material is set to a high temperature by the purified gas from the space.

According to the invention, the heating device is controlled by control means. The heat generation by the heating device is controlled by the fuel flow rate or electric power supplied to the heating device so that the temperature of the pretreatment material may be 250° C. or more. Hence the catalyst deteriorating substances in the objective gas are sufficiently removed by the pretreatment material. Hence heating and oxidation by the catalyst may be accomplished.

The invention also realizes a regenerative heat exchanger of parallel flow or counter flow type, by installing a pair of rotary distribution valves above and beneath the housing accommodating the heat exchanger column.

The rotary distribution valve of the invention may be applied not only in the regenerative combustion apparatus and regenerative heat exchanger, but also in other uses as well.

DETAILED DESCRIPTION OF THE INVENTION

Figure 1:
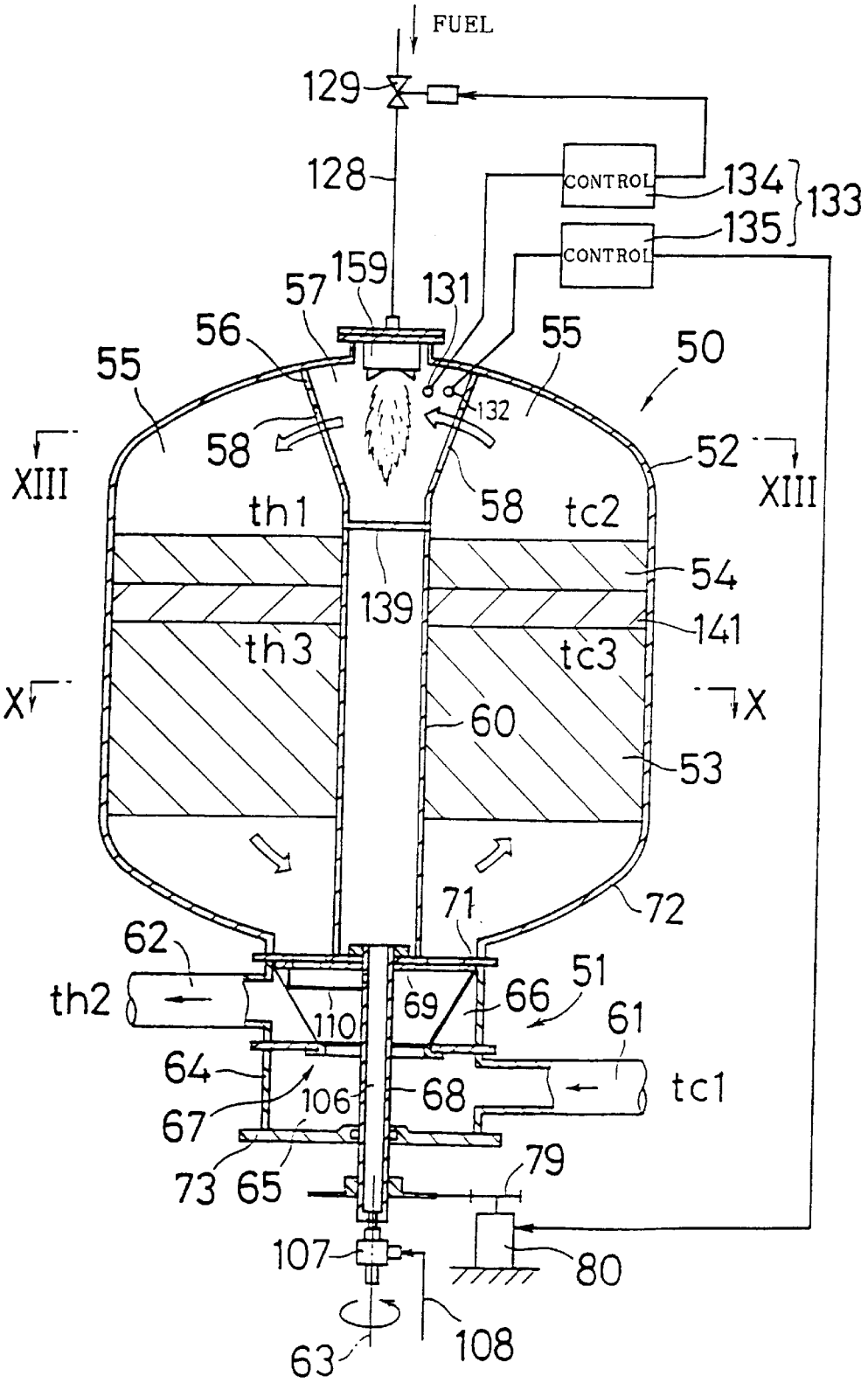
FIG. 1 is a longitudinal sectional view simplifying the general structure of a regenerative catalytic combustion apparatus.
Figure 2:
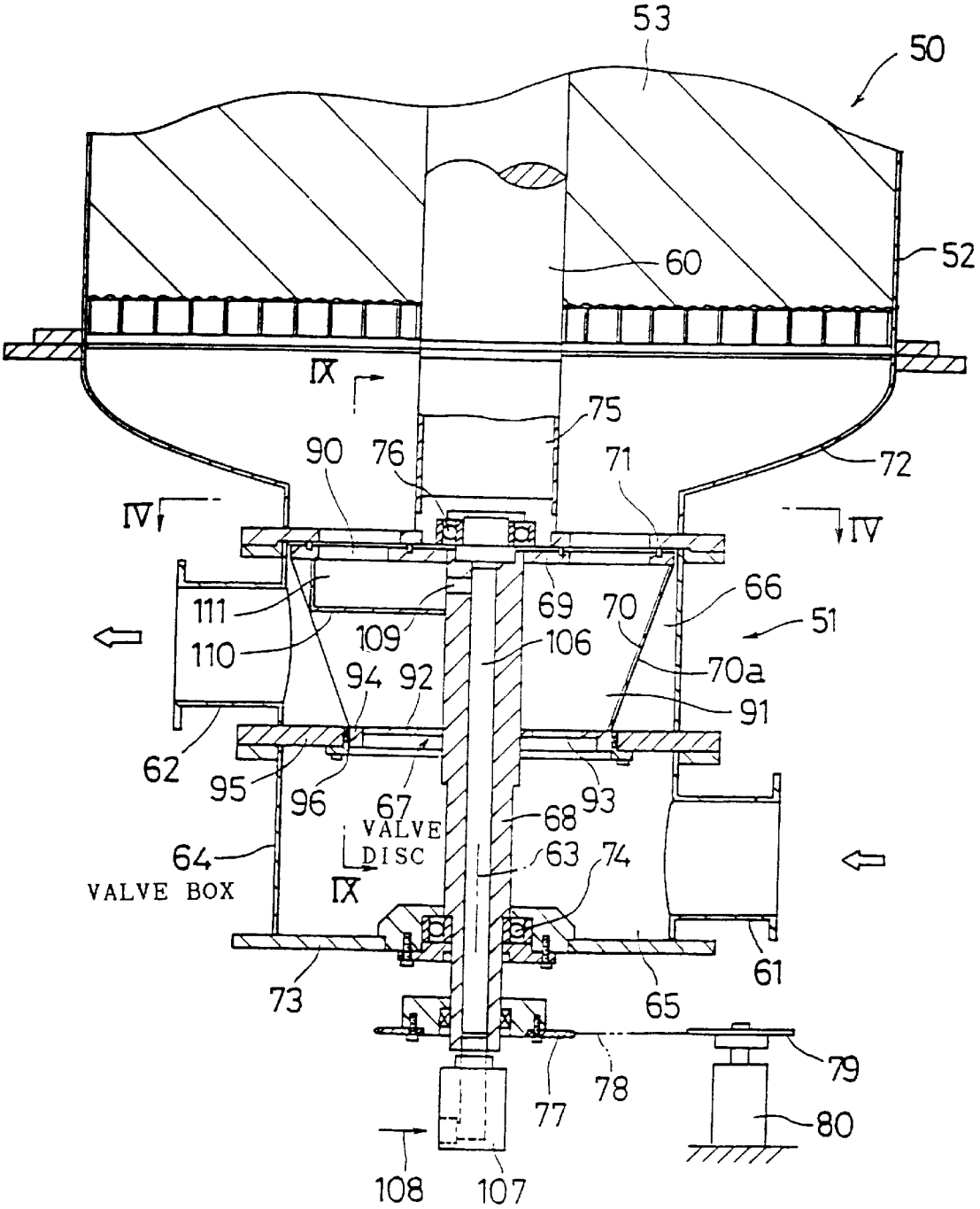
FIG. 2 is a longitudinal sectional view near the rotary distribution valve in the regenerative catalytic combustion apparatus of an embodiment of the invention.
Figure 3:
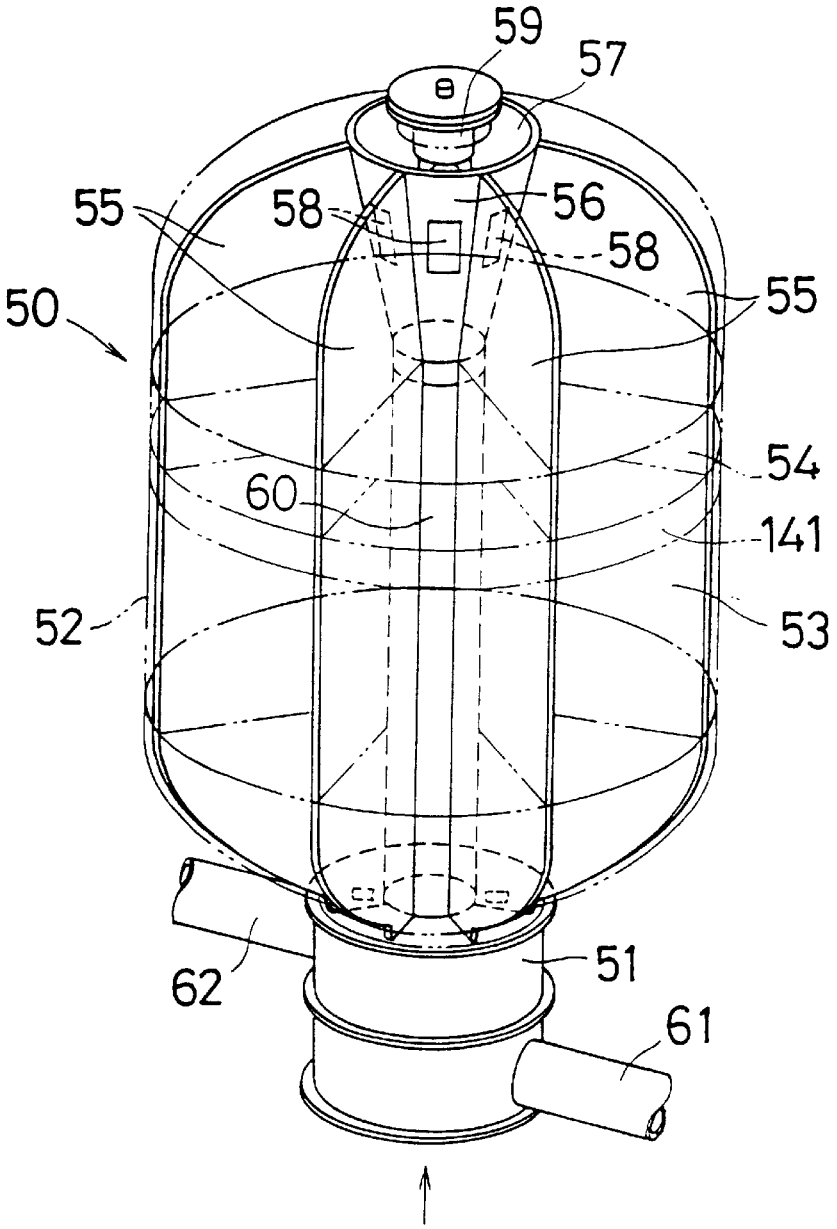
FIG. 3 is a perspective view simplifying the internal structure of the regenerative catalytic combustion apparatus.

FIG. 1 is a simplified sectional view showing a general structure of a regenerative catalytic combustion apparatus of an embodiment of the invention. FIG. 2 is a sectional view showing the rotary distribution valve 51 near the lower part of the regenerative catalytic combustion apparatus. FIG. 3 is a perspective view simplifying the internal structure of the regenerative catalytic combustion apparatus 50. Referring to these diagrams, in the housing 52 of a nearly right circular cylindrical form extending vertically, a heat exchanger column 53 of ceramic particles or Raschig rings is accommodated. A catalyst 54 for thermally decomposing the malodorous substances of the objective gas is disposed above the heat exchanger column 53. Between the heat exchanger column 53 and catalyst 54 is interposed a pretreatment material 141 for removing the catalyst deteriorating substances contained in the objective gas by oxidizing or other process. The catalyst 54 may have a base surface coated with platinum or palladium, and the pretreatment material may be Y-alumina or zeolite. In the housing 52, there are plural (eight in this embodiment) partition boards 55 extending vertically for forming vertically extending passages 84 (see FIG. 4) by separating the heat exchanger column 53 and catalyst 54 at equal intervals in the peripheral direction.

The upper parts of the partition boards 55 are fixed to a combustion chamber 57 which is formed by a partition wall 56 in a, for example, hollow inverted circular truncated conical form attached to the upper part of the housing 52. The combustion chamber is connected to the passages 84 through communicating holes 58. A bottom plate 139 for forming the bottom of the space 57 is provided in the lower part of the partition wall 56. An electric heater or a burner 59 is provided in the top of the housing 52 as heating device, and gas or liquid fuel burns in the burner 59. A hollow tubular body 60 is fixed in the lower part of the partition wall 56.

The objective gas containing malodorous substances is supplied from a connection port 61 of a rotary distribution valve 51 provided in the lower part of the housing 52, and a purified gas is conducted out from a connection port 62. In the rotary distribution valve 51, a valve box 64 of a nearly right circular cylindrical form is provided coaxially to a extending vertically perpendicular rotational axial line 63. A pair of chambers 65, 66 communicating respectively with the connection ports 61, 62 are formed in the valve box 64. A valve disc 67 rotated and driven about the axial line 63 is accommodated in the valve box 64. The valve disc 67 basically includes a rotary shaft 68, a disc-shaped moving valve member 69, and a partition wall 70. A stationary valve member 71 which is a constituent element of the rotary distribution valve 51 is fixed to a panel board 72 at the lower part of the housing 52. The rotary shaft 68 is supported by a bearing 74 which can receive a thrust force on an end plate 73 of the valve box 64. The rotary shaft 68 is also rotatably supported by a bearing 76 on a support body 75 in the housing 52 fixed integrally with the panel board 72. The rotary shaft 68 is fixed to a sprocket wheel 77. To rotate sprocket wheel 77, a chain 78 is driven by a sprocket wheel 79 which, in turn is rotated and driven by a drive source 80.

Figure 4:
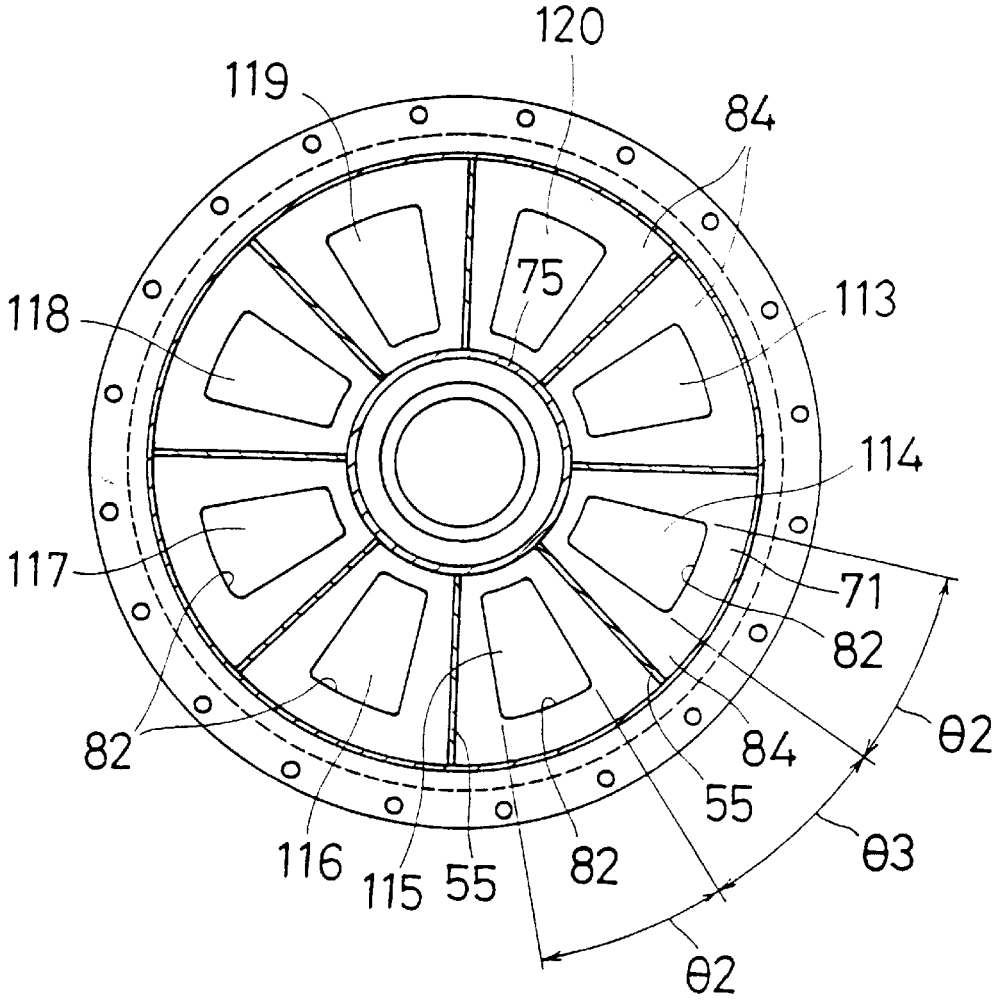
FIG. 4 is a horizontal sectional view seen from the section line IV—IV in FIG. 2.

FIG. 4 is a sectional view as seen from the section line IV—IV in FIG. 2. The stationary valve member 71 is divided equally in plural (eight in this embodiment) sections in the peripheral direction. Plural, for example, eight stationary valve ports 82 are formed at an angle $\theta$ 2. The interval of the mutually adjacent stationary valve ports 82 is formed by a third angle $\theta$ 3 in the peripheral direction. In this embodiment, the angle relation is $\theta$ 2=$\theta$ 3=22.5°. The partition boards 55 are fixed at an interval of 45° in the peripheral direction on the top of the stationary valve member 71 between mutual stationary valve ports 82. Passages 84 extending vertically in eight divisions are formed in the housing 52, and each passage 84 communicates with one stationary valve port 82.

Figure 5:
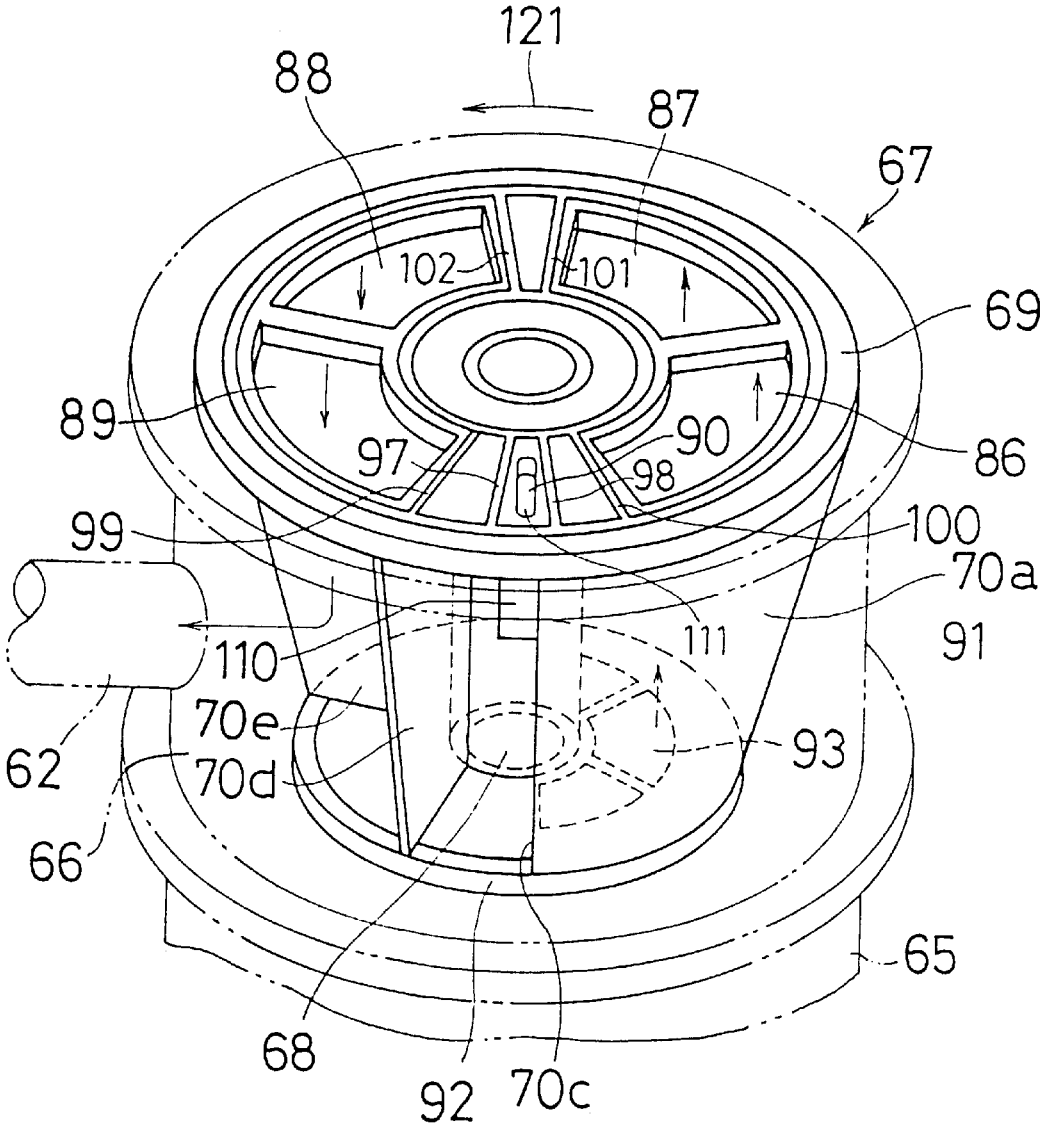
FIG. 5 is a perspective view simplifying a partial structure of the valve disc.
Figure 6:
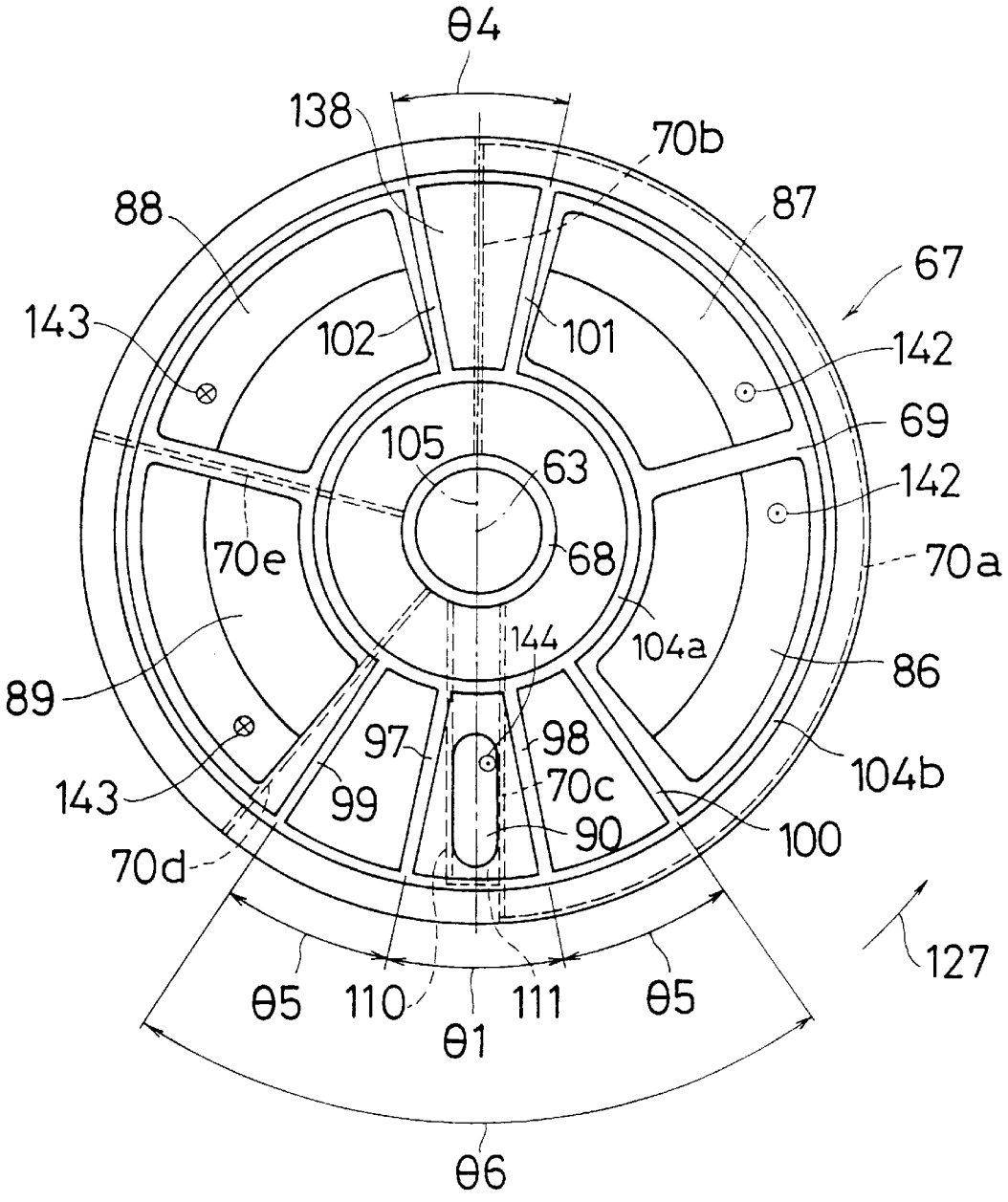
FIG. 6 is a plan view of the valve disc.
Figure 7:
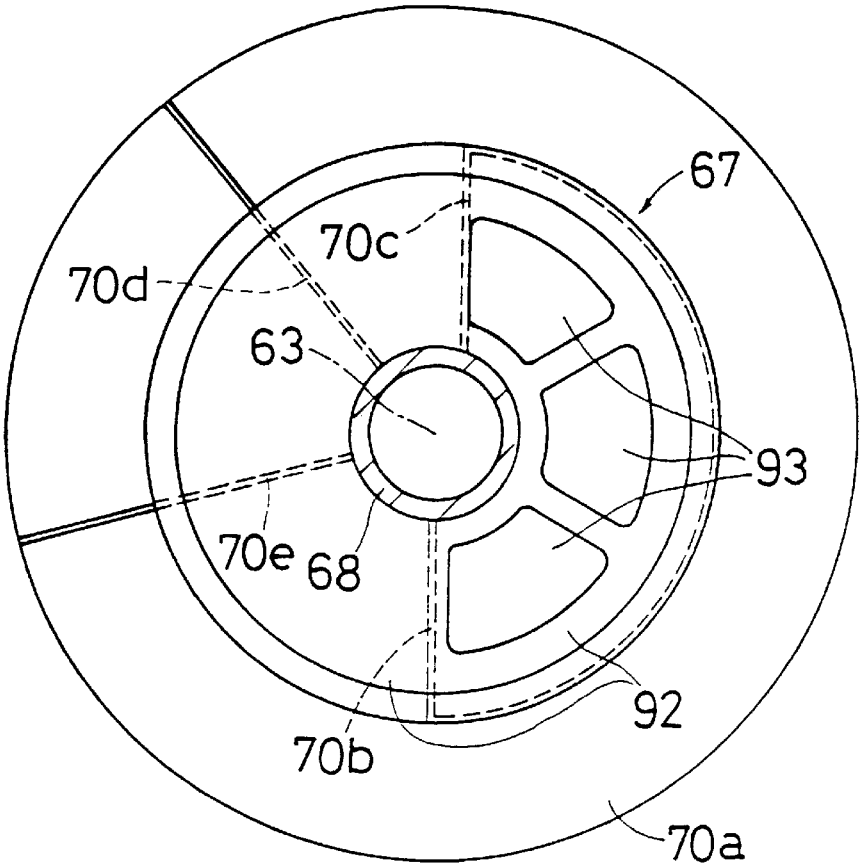
FIG. 7 is a bottom view of the valve disc.

FIG. 5 is a simplified perspective view of the valve disc 67. FIG. 6 is a plan view of the valve disc 67. FIG. 7 is a bottom view of the valve disc 67. Referring now to these diagrams, the moving valve member 69 is disc-shaped, and is vertically fixed to the rotary shaft 68 at a position facing chamber 66. In the moving valve member 69, first moving valve ports 86, 87 and second moving valve ports 88, 89 are formed in the peripheral direction around the axial line 63. A third moving valve port 90 is formed at an interval in the peripheral direction from these first and second moving valve ports 86, 87; and 88, 89.

The third moving valve port 90 is formed at one side between the first and second moving valve ports 86, 89 along the peripheral direction of the valve disc 67. The other side between the first and second moving valve ports 87, 88 along the peripheral direction is a changeover part 138. In FIG. 6. in the first moving valve ports 86, 87, the objective gas rises and passes as indicated by reference numeral 142 as described later. In the second moving valve ports 88, 89, as indicated by reference numeral 143, purified gas flows down. In the third moving valve port 90, as indicated by reference numeral 144, a clean purging air rises.

The changeover part 138 spreads in the peripheral direction so as to divide and allows change over of at least one (one in this embodiment) stationary valve port 82. On the side of the change over part along the peripheral direction between the first and second moving valve ports 87, 88 as mentioned above the changeover part has angle indicated by reference numeral θ 4 between the seal members 101 and 102 in FIG. 6.

The changeover part 138 is used to change over the flow of gas from an upward flow to a downward flow as mentioned later in relation to the operation. In the plural passages 84, 113 to 120, the gas is always flowing upward or downward, only momentarily stopping in the state shown in FIG. 11 (1). In the passage 82*a* in FIG. 11 (1), the gas flow direction is changed instantly from downward to upward.

The partition wall 70 specifically includes an arcuate partition wall 70*a,* and flat partition walls 70*b,* 70*c,* 70*d,* 70*e,* and is comprehensively indicated by reference numeral 70. The partition wall 70*a* approximately has a shape for forming part of a hollow circular truncated cone. Its upper part is fixed to the lower side of the moving valve member 69, and similarly the flat partition walls 70*b,* 70*c* are also fixed to the lower side of the moving valve member 69. The partition walls 70*b,* 70*c* are further fixed to the outer circumference of the rotary shaft 68 along the axial direction, thereby forming a guide space 91 communicating between the chamber 65 and the first moving valve ports 86, 87. This guide space 91 is hermetically partitioned from the other chamber 66 by means of the partition walls 70*a,* 70*b,* 70*c*. The partition walls 70*d,* 70*e* are used for reinforcing the moving valve member 69. In the lower part of the partition wall 70*a,* another partition wall 92 is fixed. A communicating hole 93 for communicating between the guide space 91 and the chamber 65 is formed in this partition wall 92. The partition wall 92 also partitions the chambers 65, 66 outside of the guide space 91. A short tubular part 94 is fixed to the outer circumference of the partition wall 92. A seal member 96 is provided between the outer circumference of the short tubular part 94 and a partition wall 95 formed in the valve box 64 to form an airtight connection.

Above the moving valve member 69, an annular inner seal member 104*a* and an annular outer seal member 104*b* are provided concentrically about the axial line 63. Additional seal members 97, 98 extending in the radial direction and auxiliary seal members 99, 100 as well as seal members 101, 102 are also provided above the moving valve member 69. As shown in a sectional view in FIG. 8, the seal member 97 is embedded and fixed in an accommodating hole 103 formed in the moving valve member 69. The upper part of the seal member 97 elastically contacts with the lower side of the stationary valve member 71, and therefore forms an airtight connection. The seal member 97 may be O-ring or other structure.

The peripheral angle between the seal members 97, 98 of the third moving valve port 90 is θ 1, which is set at 22.5° in this embodiment. Moreover, at an angle of θ 5 at both sides in the peripheral direction of the seal members 97, 98, the auxiliary seal members 99, 100 are provided. Furthermore, with respect to the seal members 97, 98, the seal members 101, 102 are, respectively, provided symmetrically around the axial line 63. The peripheral angle θ 4 between the seal members 101, 102 is 22.5° in this embodiment. In this way, the seal members 104*a,* 104*b;* 97, 98; 99, 100; and 101, 102 are disposed symmetrically with respect to a plane of symmetry 105. In this embodiment, θ 1=θ 2=θ 3=θ 4=θ 5.

Referring back to FIG. 1, a shaft hole 106 along the axial line 63 is formed on the rotary shaft 68, and a rotary tube joint 107 is connected to its lower part. Purging air is force-fed into the rotary tube joint 107 through a duct 108. The upper connection hole 109 of the rotary shaft 68 communicates with the third moving valve port 90 through a communicating passage 111 formed by an auxiliary partition wall 110.

Figure 9:
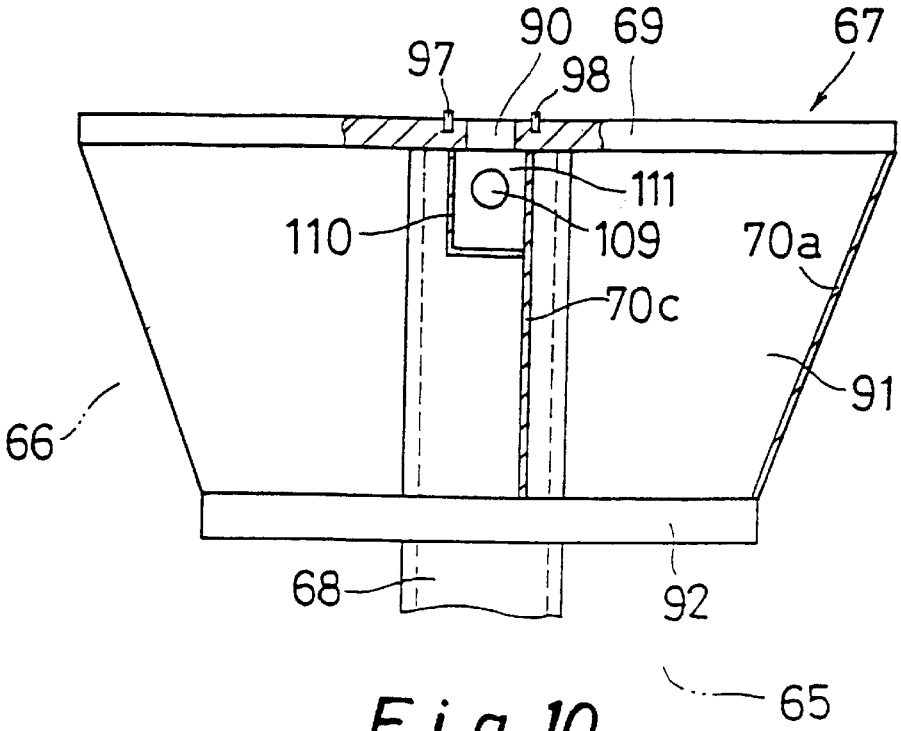
FIG. 9 is a sectional view showing part of the valve disc taken on line IX—IX in FIG. 2.

FIG. 9 is a sectional view showing part of the valve disc 67 seen from the sectional line IX—IX in FIG. 2. The auxiliary partition wall 110 is fixed from the partition wall 70*c* to the lower side of the moving valve member 69. The communicating passage 111 places the third moving valve port 90 into communication with shaft hole 106 through a connection hole 109.

Figure 10:
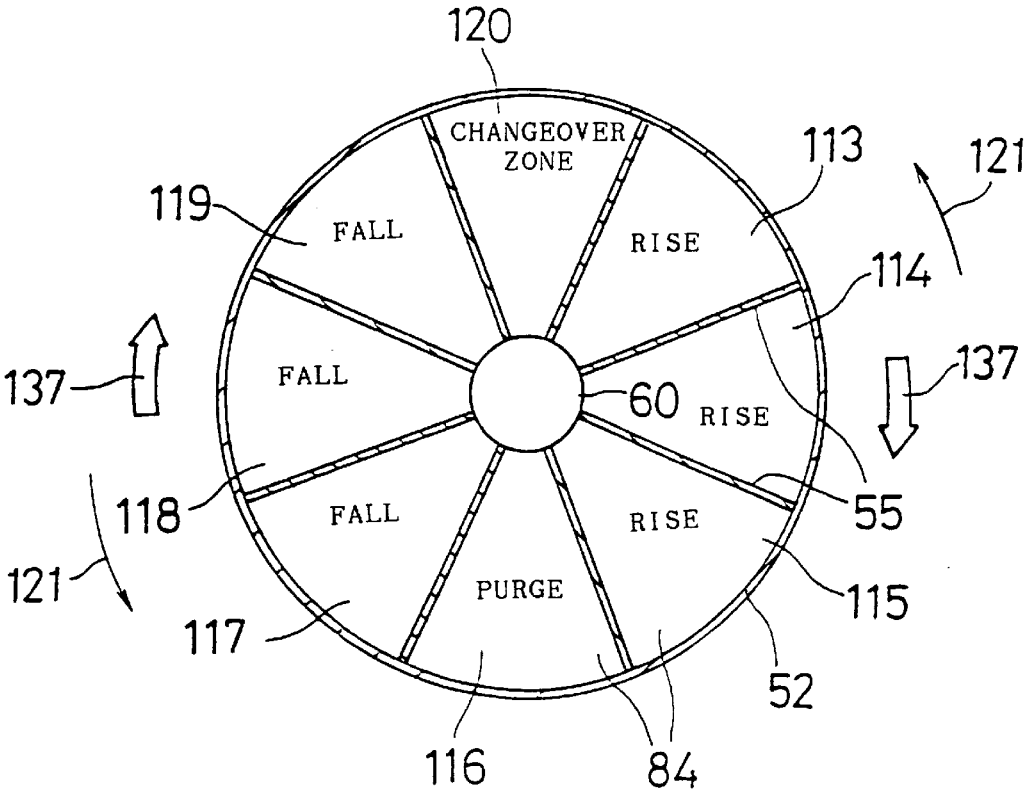
FIG. 10 is a simplified sectional view of the housing in FIG. 1 taken on line X—X.

FIG. 10 is a horizontal sectional view of the lower part of the housing 52 seen from the section line X—X in FIG. 1. In the regions 113 to 120 formed by a total of eight passages 84 partitioned by the partition boards 55 in the housing 52, the heat reserve material 53 and catalyst 54 are accommodated as mentioned above. By the function of the rotary distribution valve 51, the objective gas absorbs the heat accumulated in the heat exchanger column 53 and ascends in the regions 113 to 115. It is purged by air in the region 116. The purified gas in which the malodorous substances are oxidized and decomposed descends, and the heat is released and accumulated in the heat exchanger column 53 in the regions 117 to 119. In addition, the region 120 is airtight and is thus termed the changeover zone 120. For example, when the valve disc 67 of the rotary distribution valve 51 rotates in the direction of an arrow 121, a certain region 115 in the housing 52 is changed, as indicated by an arrow 137, between the following periods: the objective gas elevating period (see FIG. 11 (1)), air purging period (FIG. 11 (4)), and purified gas descending period.

As a result, during the purging period when the objective gas remaining in the region 115 where the objective gas containing malodorous substances has been supplied and elevated, purging air is elevated and the region 115 is purified. Then the purified gas after oxidation and decomposition of the malodorous substances is conducted or moved in, thereby preventing the objective gas containing malodorous substances from mixing into the chamber 66 and connection port 62.

Figure 11:
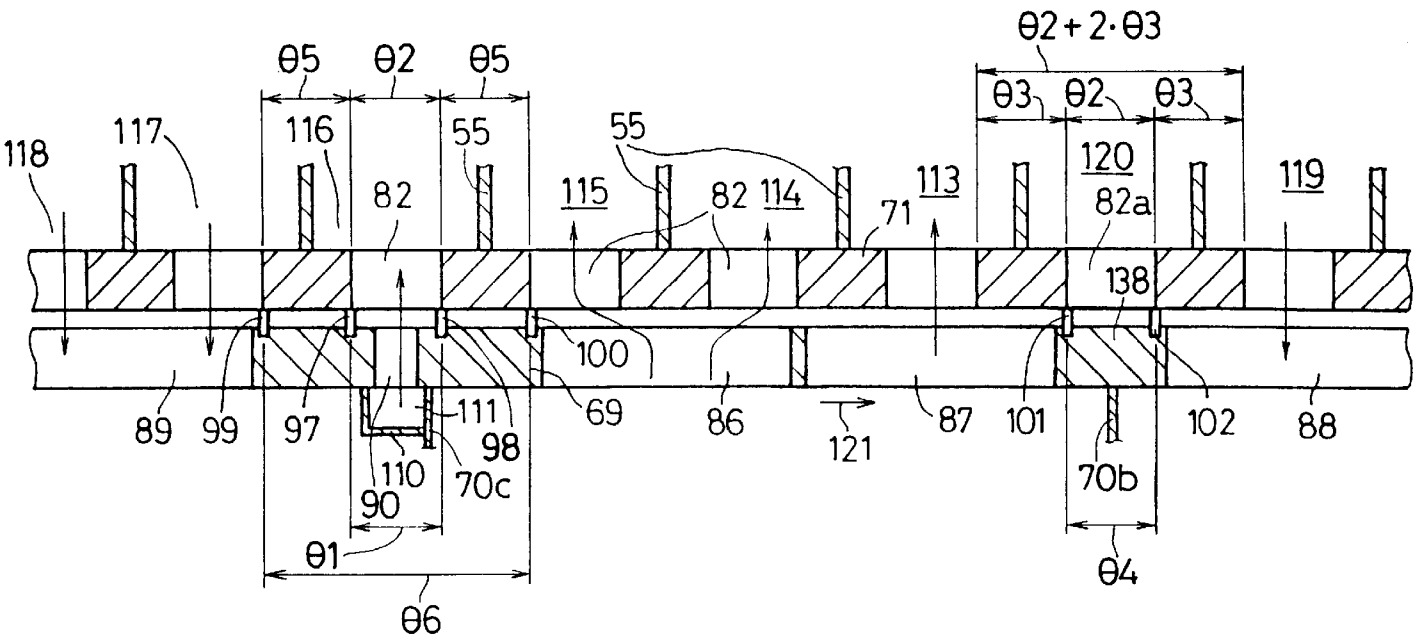
FIG. 11 is a sectional view for explaining the operation of the moving valve member and stationary valve member developed in the peripheral direction for describing the operation of the rotary distribution valve.
Figure 11:
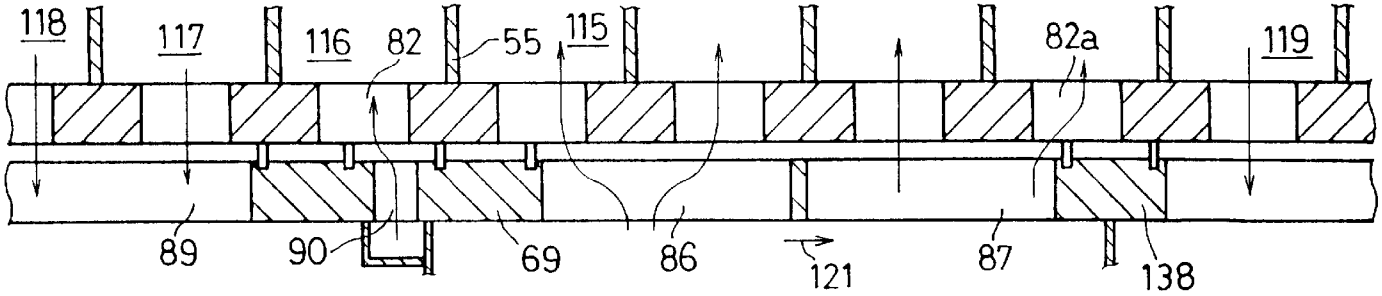
Figure 11:
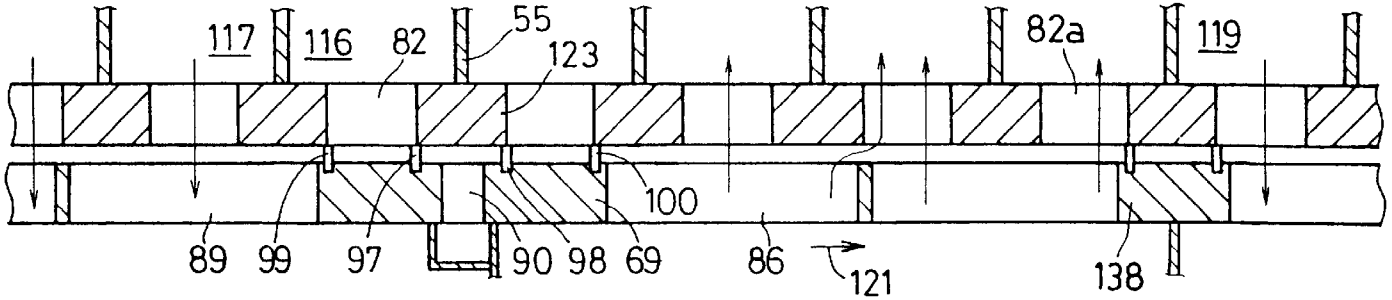
Figure 11:
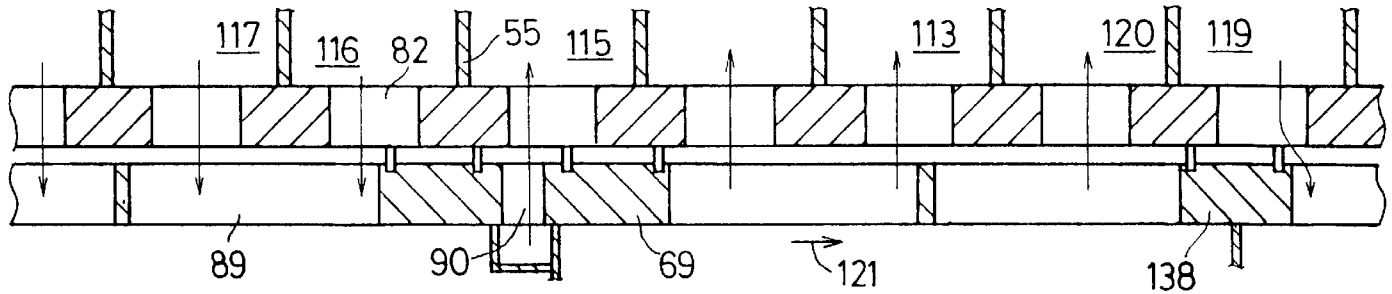

FIG. 11 is a development diagram in the peripheral direction of the rotary distribution valve 51. In FIG. 11 (1), in the region 116, for example, which is also one of the passages 84 partitioned by the partition boards 55 in the housing 52, the purging air is ascending through the third moving valve port 90 and the stationary valve port 82. The stationary valve port 82*a,* which is one of the plural (eight in this embodiment) stationary valve ports 82, is kept airtight by the seal members 101, 102. Therefore the objective gas and purified gas will not mix into the region 120 which is the changeover zone.

Next, as shown in FIG. 11 (2), as moving valve member 69 moves continuously the purging air is continuously supplied into the region 116. Thus the objective gas remaining in the region 116 is moved to the upper part of the housing 52 by the purging air. After oxidation and decomposition of the malodorous substances in region 116 is complete, as shown in FIG. 11 (3), the seal members 97, 98 contact with the portion 123 of the stationary valve member 71 adjacent to the stationary valve ports 82 through which the purging air has been passing, so that the purified gas can descend and flow in the region 116.

As the moving valve member 69 further rotates, as shown in FIG. 11 (4), the purge region is shifted to the region 115 where the objective gas has been ascending. Thus, leakage from the objective gas ascending region 115 into the purified gas descending region 117 does not occur. The effect is the same in the changeover zone 120 due to the seal members 101, 102.

In the foregoing embodiment, the objective gas is supplied into one chamber 65, and purified gas is conducted into the other chamber 66 and discharged. But in another embodiment of the invention, contrary to the above embodiment, the objective gas may be supplied into the chamber 66, and purified gas may be conducted into the chamber 65 and discharged.

One important feature of the invention is that, because of the rotary distribution valve 51 in the region 120 serving as changeover zone in FIG. 11 (1), at the next moment, the objective gas ascends as shown in FIG. 11 (2). Then, after the state in FIG. 11 (3) in which the objective gas is ascending, the purified gas descends. Immediately before FIG. 11 (1), the purified gas is descending in the region 120. After moving from the state in FIG. 11 (1), the objective gas ascends in the state in FIG. 11 (2) as mentioned above. Therefore, while the valve disc 67 of the rotary distribution valve 51 is rotating, out of regions 113 to 120 consisting of a total of eight passages 84 in the housing 52 only the one region 116 in FIG. 16 does not have objective gas or purified gas flowing. Therefore, the time for using the heat exchanger column 53, catalyst 54 and pretreatment material 141 is extended, and the operation efficiency is enhanced. This is one of the important advantages of the invention.

In this embodiment, as mentioned above, the angle relation is selected as $\theta 1=\theta 2=\theta 3=\theta 4=\theta 5$, but according to the invention, by selecting $$\theta 2+\theta 3\geqq\theta 1\geqq\theta 2, \text{ and}$$

$$\theta 3\geqq\theta 2,$$

leakage of gas can be prevented. Further according to the invention, by defining $$\theta 3\geqq\theta 2,$$

the porosity of the stationary valve member 71 may be set less than 50%, and gas leak may be prevented.

An angle $\theta 6$ between the auxiliary seal members 99, 100 is selected as $$\theta 2+2\cdot\theta 3\geqq\theta 6\geqq\theta 2,$$

so that the leakage of gas can be prevented.

The angle $\theta 4$ between the pair of seal members 101, 102 provided at both sides in the peripheral direction of the changeover part 138 is selected as $$\theta 4\approx\theta 2.$$

Hence, in the present embodiment, because of the changeover part 138, the single stationary valve port 82*a* can be securely enclosed hermetically.

Figure 8:
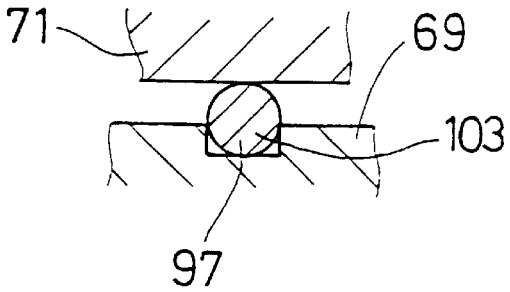
FIG. 8 is a sectional view of the seal member.
Figure 12:
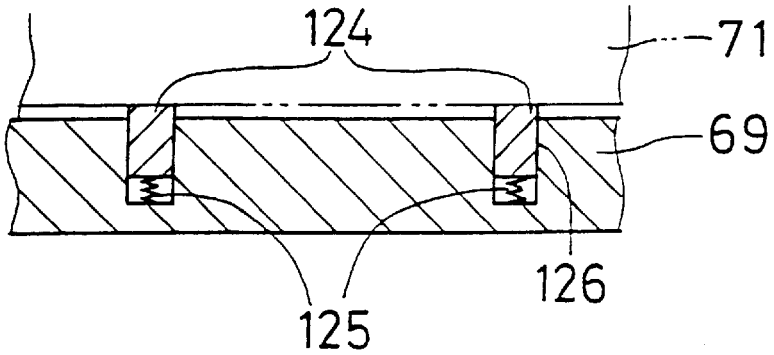
FIG. 12 is a sectional view for showing a seal member of another embodiment of the invention.

In other embodiments of the invention, instead of the seal member 97 mentioned to FIG. 8, when high temperature gas is used, in particular, as shown in FIG. 12, an elastic force may be given to a seal member 124 made of ceramic or similar material by using a spring 125. The seal member 124 may contact the lower surface of the stationary valve member 71, thus forming an airtight connection. The seal member 124 and spring 125 are fitted into a recess 126 formed opposite to the moving valve member 69. This arrangement shown in FIG. 12 may be similarly utilized in relation to all other remaining seal members 104*a*, 104*b*, 98 to 102.

Figure 13:
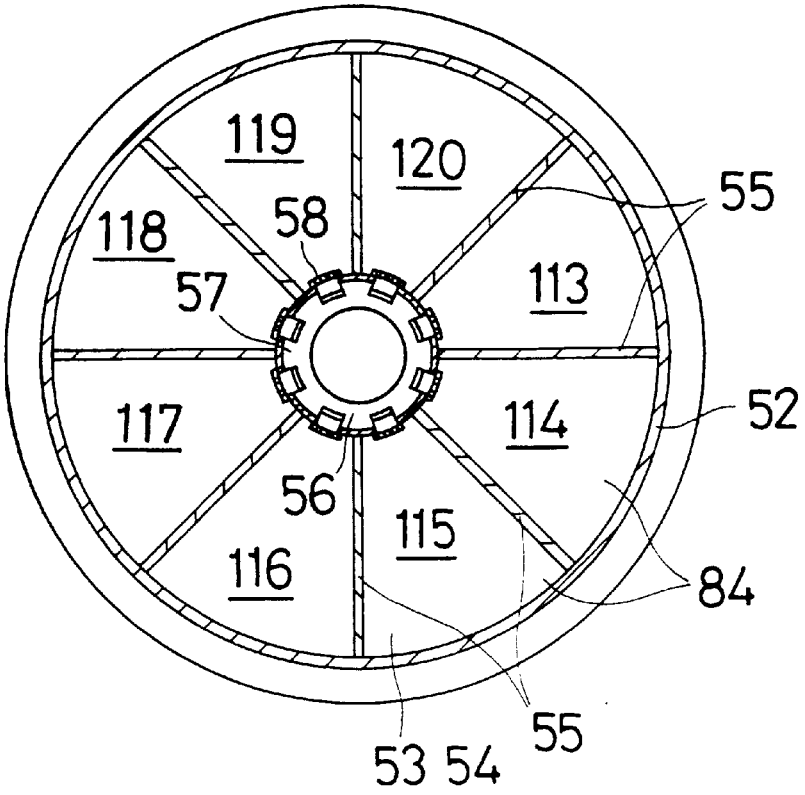
FIG. 13 is a simplified horizontal sectional view taken on line XIII—XIII in FIG. 1.

FIG. 13 is a simplified horizontal sectional view taken on line XIII—XIII in FIG. 1. The upper parts of the partition boards 55 are fixed to the partition wall 56 hermetically. Also the lower parts of the partition boards are hermetically fixed to a tubular body. The lower part of the partition boards 55 is fixed hermetically to the stationary valve member 84 as shown in FIG. 4. The partition wall 56 is hermetically fixed to the panel board of the upper part of the housing 52. The partition wall 56 has communicating holes 58 which each communicate with the passages 84, 113 to 120 partitioned by the partition boards 55.

Figure 14:
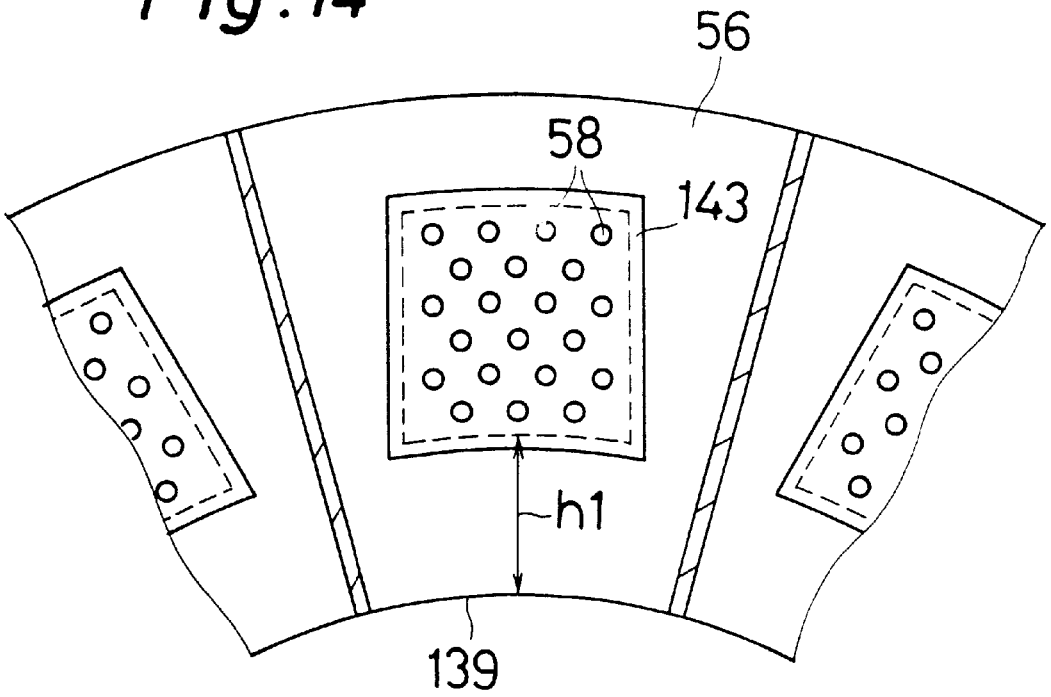
FIG. 14 is a developed diagram in the peripheral direction of the partition wall for the space.
Figure 15:
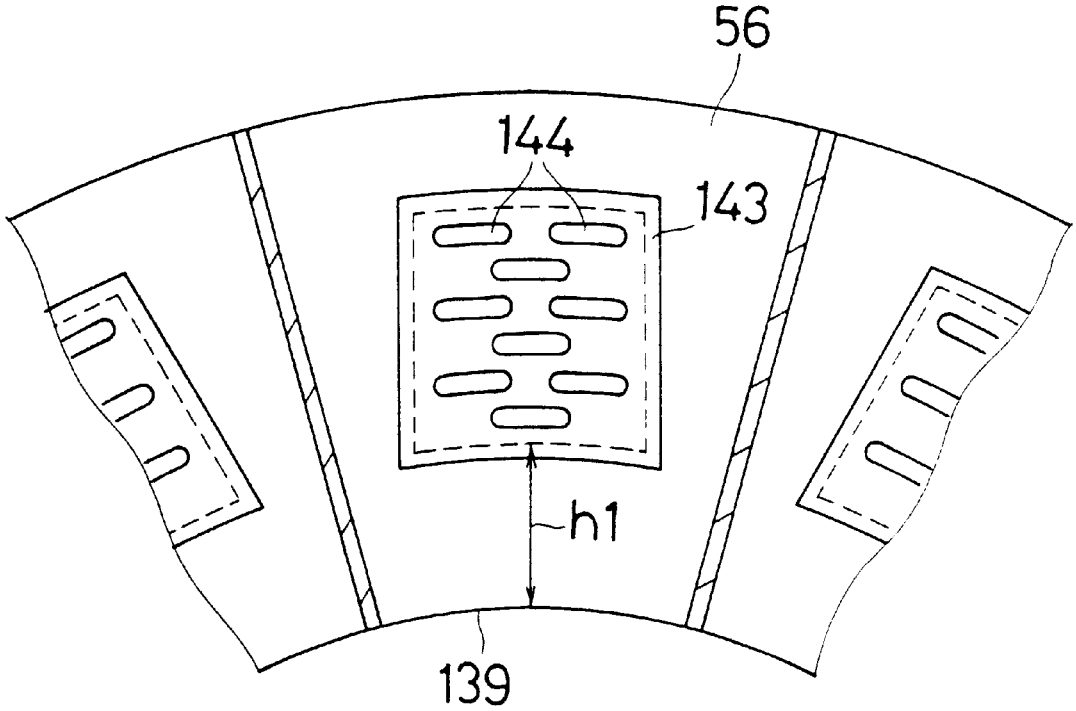
FIG. 15 is a different embodiment of the developed diagram in the peripheral direction of the partition wall of FIG. 14.

FIG. 14 is a developed diagram in the peripheral direction of part of the partition wall 56. The communicating holes 58 include multiple pores formed in a porous plate 143, for instance so-called punching metal. The pores 58 are disposed discretely. The communicating holes 58 are discretely formed slightly above a clearance of hl above from the upper surface of the bottom plate 139. The communicating holes 58 may be circular as shown in FIG. 14. In another embodiment shown in FIG. 15, the communicating holes 58 may be slender in the peripheral direction, or oval shaped as indicated by reference numeral 144, or in some other shape.

These communicating holes 58, 144 are provided at a distance of hi from the upper surface of the bottom plate 139 as mentioned above, and are formed at a distance hi above from the upper part of the catalyst 54. Therefore, the objective gas flows into the chamber 65 from the connection port 61 as stated above, ascends in the housing 52, and flows into the space 57 through the communicating holes 58. Hence it is prevented from mixing with the purified gas and from short-circuiting in the chamber 66 side.

The operating conditions are set so that the wind velocity of the ascending objective gas blown into the chamber 57 through the communicating holes 58 may be, for example, about 5 to 20 m/sec. In other words, the inside diameter and number of communicating holes 58 are determined, and the supply flow rate of the objective gas is also defined. This range of wind velocity is to ensure a uniform temperature distribution by gas mixing in the chamber 50. This is described in detail by referring to FIG. 16 and FIG. 17. According to the results of an experiment by the present inventor disclosed in FIG. 16 and FIG. 17, the inside diameter of the housing 52 is 1.2 $\phi$, the flow rate of the objective gas from the connection port 61 is 20 $Nm^3$/min, and the space 56 is kept constant at 350° C. by the burner 59 or electric heater.

Figure 16:
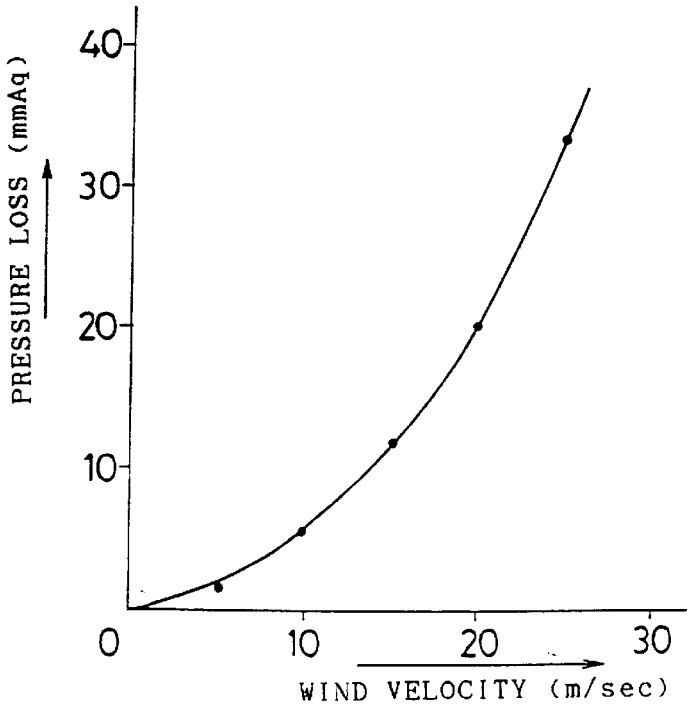
FIG. 16 is a graph showing the relation between the wind velocity and pressure loss relating to the communicating holes.

FIG. 16 is a graph showing the relation between the wind velocity and the pressure loss of the objective gas passing through the communicating holes 58. When the wind velocity of the objective gas passing through the communicating holes 58 exceeds about 20 m/sec, it is known that the pressure loss increases suddenly. In the invention, therefore, the wind velocity is set at 20 m/sec or less in the communicating holes 58.

Figure 17:
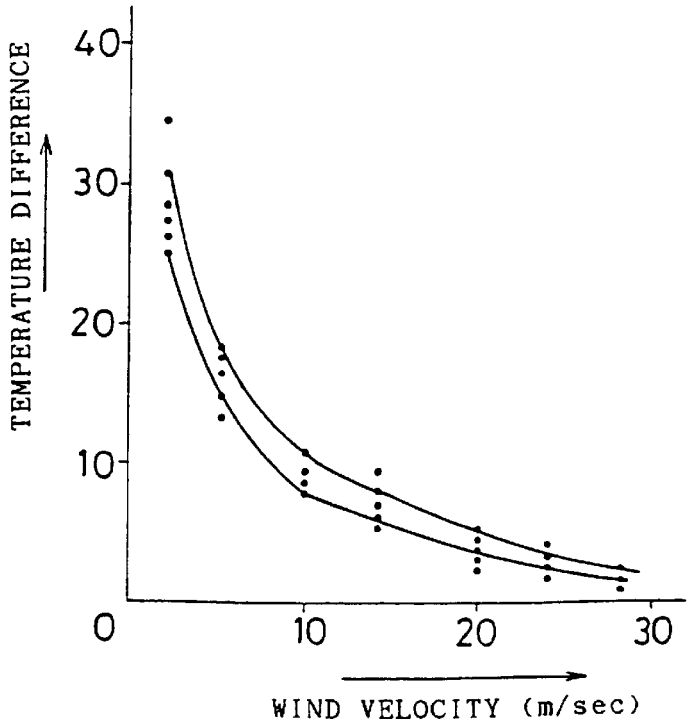
FIG. 17 is a graph showing the relation between the wind velocity relating to the communicating holes and the temperature difference between the maximum temperature and minimum temperature in the distribution of the purified gas discharged from the space.

FIG. 17 is a graph showing the relation between the wind velocity when the purified gas descends from the space 57 through the communicating holes 58, and the temperature difference between the maximum temperature and minimum temperature of the gas distributed immediately before being discharged in the space 57. The higher the wind velocity, the more the gas is mixed in the space 57 thereby decreasing the temperature difference so that the temperature distribution becomes uniform. But as mentioned by reference to FIG. 16, the pressure loss increases abruptly with a large wind velocity. Or if the wind velocity is too small when the purified gas is discharged from the space 57 through the communicating holes 58, the pressure loss is also small. But, to the contrary, if the temperature difference of the temperature distribution of the purified gas is too large, and the gas is not mixed sufficiently, the objective gas will not be heated, and will therefore be discharged while the oxidation is insufficient. Hence, in the invention, the wind velocity of the objective gas blown into the space 57 is set at approximately 5 m/sec or more.

Figure 18:
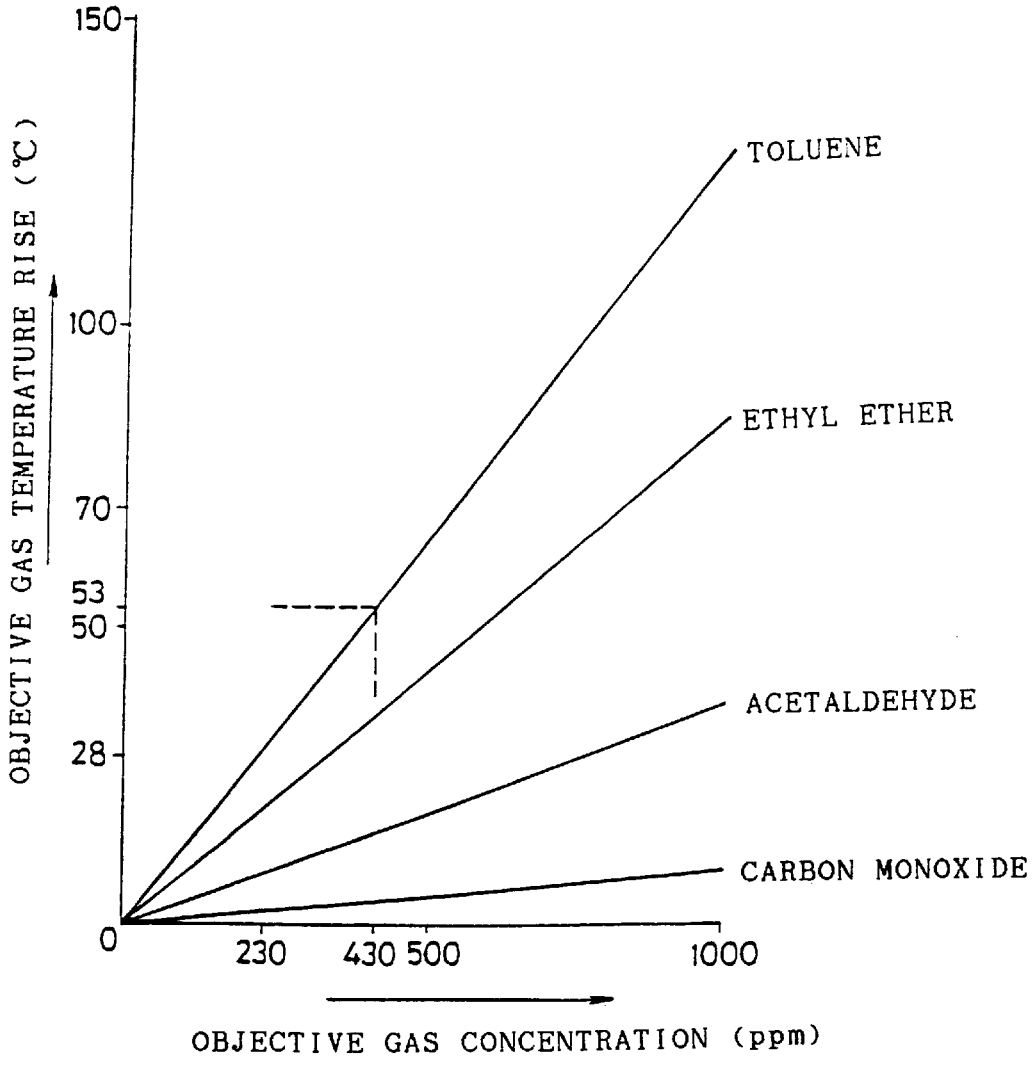
FIG. 18 is a graph showing the relation between the concentration of organic solvent contained in the objective gas, and the corresponding temperature rise portion $\Delta$ T.

By burning the objective gas containing organic solvent by using the catalyst 54 and further by using the burner 59, the temperature of the objective gas rises as shown in FIG. 18 because of the combustion heat of the organic solvent contained in the objective gas. In the regenerative catalytic combustion apparatus 50 of the above embodiment, the reaction temperature in the stationary state is generally about 300 to 350° C., and the heat resisting temperature of the catalyst 54 and pretreatment material 141 is about 550° C.

The performance of the regenerative catalytic combustion apparatus is expressed by the heat exchange efficiency ϕ defined in formula 1.

$$(t\,c\,2^{*}-t\,c\,1)/(t\,h\,1-t\,c\,1) \tag{1}$$

where t is the gas temperature [° C.], subscripts c and h respectively denote cold side and hot side, 1 and 2 indicate the inlet and outlet, and tc2* represents the outlet mean temperature of the cold side gas.

Figure 19:
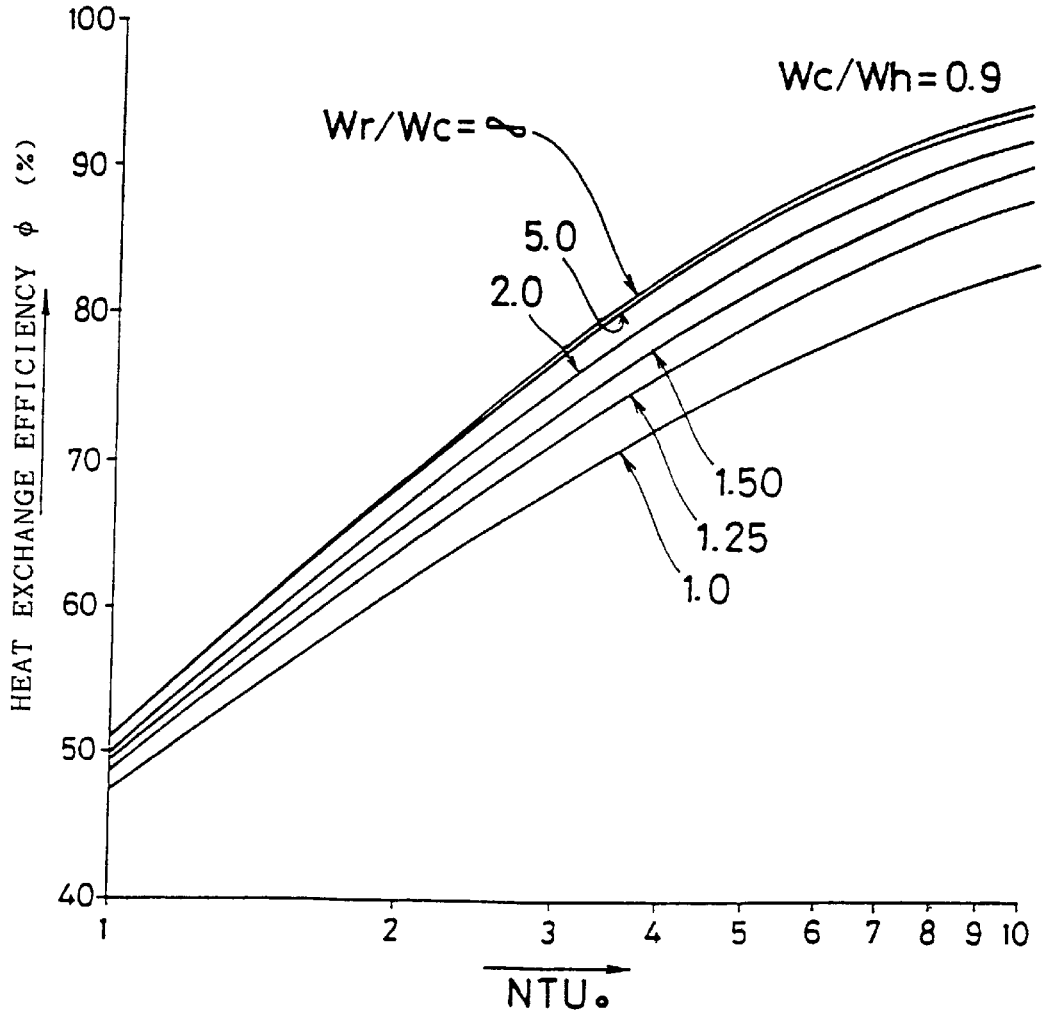
FIG. 19 is a graph showing the heat exchange efficiency $\phi$ of the regenerative catalytic combustion apparatus.

FIG. 19 is a graph showing the heat exchange efficiency of the regenerative catalytic combustion apparatus 50. The value of the heat exchange efficiency ϕ is calculated by assuming that the specific heat and heat transfer coefficient of gas are constant regardless of time and position, and that there is no loss due to leakage or carryover. In the diagram NTUo is a dimension less number called NTU or Overall Number of Transfer Unit, which is defined in formula 2.

$$NTU_0 = \frac{1}{Wc}\left[\frac{1}{(1/hA)c + (1/hA)h}\right] \tag{2}$$

where h is heat transfer coefficient [kcal/m$^2$.Hr.° C.]. A heating area [m$^2$], and Hr is hour. Moreover, Wc is water equivalent of one gas, that is, the objective gas or purified gas, and Wr is water equivalent of the heat exchanger column 53, which are respectively given in formulas 3 and 4.

$$Wc=G\cdot cp[\text{kcal}/^{\circ}\text{ C.}\cdot\text{Hr}] \tag{3}$$

$$Wr=n\cdot Mr\cdot cr[\text{kcal}/^{\circ}\text{ C.}\cdot\text{Hr}] \tag{4}$$

where n is the rotating speed of the valve disc 67 of the rotary distribution valve 51, that is, the changeover speed [rpHr], G and cp are weight flow rate [kgf/Hr] and specific heat at constant pressure [kcal/kgf. ° C] of one gas, and Mr and cr are total weight [kgf] and specific heat of the heat exchanger column 53.

Table 1 shows the running statuses 1 to 4 of the regenerative catalytic combustion apparatus 50.

TABLE 1

| | RUNNING STATUS | | | |
|---|---|---|---|---|
| | 1 | 2 | 3 | 4 |
| ROTATING SPEED n(rph) | 60 | 60 | 18 | 12 |
| WATER EQUIVALENT RATIO (Wr/Wc) | 5.0 | 5.0 | 1.5 | 1.0 |
| HEAT EFFICIENCY ϕ (%) | 90 | 90 | 85 | 79 |
| INLET TEMPERATURE OF PURIFIED GAS tc1 (° C.) | 20 | 20 | 20 | 20 |
| TEMPERATURE OF SPACE 57 (° C.) tc2 = th1 | 300 | 550 | 550 | 550 |
| OUTLET TEMPERATURE OF PURIFIED GAS th2 (° C.) | 48 | 73 | 100 | 131 |
| TEMPERATURE DIFFERENCE ΔT = th2 − tc1 (° C.) | 28 | 53 | 80 | 111 |
| TOLUENE CONCENTRATION IN OBJECTIVE GAS (ppm) | 230 | 430 | 640 | 890 |

When the regenerative catalytic combustion apparatus 50 is designed at the changeover speed of the rotary distribution valve 51 of 60 rpHr, water equivalent ratio Wr/Wc=5, and heat exchange efficiency Φ=90%, the inlet temperature tc1 of the objective gas at the connection port 61 is 20° C. and the temperature in the combustion chamber 57 is controlled at 300° C. by the burner 59, the outlet temperature th2 of the purified gas from the connection port 62 is 48° C. as shown in formula 5.

$$th2=20+(300-20)\times 0.1=48 \tag{5}$$

Therefore, the temperature difference Δ T (=th2−tc1) at the connection ports 61, 62 is 28° C., and when the concentration of the organic solvent is equivalent to the heat generation corresponding to this temperature difference Δ T=28° C., it is not necessary to operate the burner 59, and the objective gas burns by itself. For example, when the organic solvent is toluene, it is known from FIG. 18 that the concentration corresponding to the objective gas temperature rise of 28° C. is 230 ppm. Therefore, in the objective gas containing toluene by 230 ppm, the temperature difference Δ T=28° C. Such action is indicated as running status 1 in Table 1.

Running status 2 is described below. When the concentration of toluene used as the organic solvent in the objective gas is high and the reaction temperature indicated by the temperature tc2, th1 is 550° C., the temperature of the purified gas at the connection port 62 is 73° C. as indicated in formula 6, and the temperature difference Δ T is =53° C.

$$th2=20+(550-20)\times 0.1=73 \tag{6}$$

The toluene concentration corresponding to this temperature difference Δ T is 430 ppm as seen from FIG. 18. Therefore, when the toluene concentration exceeds 430 ppm, the catalyst 54 and pretreatment material 141 exceed the heat resisting temperature, and hence the running status 2 cannot be continued.

The inventor, accordingly, noticing that the heat exchange efficiency Δ is changed by varying the water equivalent ratio Wr/Wc, succeeded in prevention of abnormal temperature rise of the catalyst 54 and pretreatment material 141 by changing the changeover speed n of the rotary distribution valve 51 to vary the water equivalent ratio Wr/Wc, so as to lower the heat exchange efficiency Δ when the concentration of the organic solvent rises. Thus, in the running statuses 3, 4 where the toluene concentration is raised as compared with the running status 2 in Table 1 and as the toluene concentration rises, the changeover speed n of the rotary distribution valve 51 is lowered, and the temperature of the catalyst 54 is suppressed around 550° C. .@102.

To operate automatically in the running statuses 1 to 4, the invention is arranged as follows. Referring back to FIG. 1, temperature detecting devices 131, 132 for detecting the temperature of purified gas are provided in the combustion chamber 57. The output of one temperature detecting device 131 is given to one control circuit 134 of control device 133. The opening and closing action of a flow rate control valve 129 or flow rate is controlled by t4e output of the control circuit 134.

The output of the other temperature detecting device 132 is given to a control circuit 135 provided in the control device 133, and the control circuit 135 controls the rotating speed of the motor 80. Accordingly the rotating speed of the valve disk 67, hence the changeover speed of the rotary distribution valve 51 is set to a speed corresponding to the detected temperature.

In the invention, instead of the rotary distribution valve 51 having the above-mentioned structure a rotary distribution valve of an other structure may be employed. For example, the rotary distribution valve may be designed to change over the plural passages partitioned by the partition boards 55 by means of an opening and closing valve, or it may be designed in other structure.

To remove the organic solvent of the objective gas containing the organic solvent, that is, malodorous substances discharged from paint factory or other various factories, as known widely hitherto, the objective gas is preheated by means of the heat reserve material by passing through the heat reserve material in the axial direction partially in the peripheral direction. The gas is then is burnt by a catalyst, and any remaining organic solvent is burnt additionally by a burner. After passing through the catalyst, the purified gas is passed through the remaining portion of the heat reserve material in the axial direction through the catalyst to heat the heat reserve material, and is then discharged.

When the temperature becomes, for example, 550° C. or more after the organic solvent of the objective gas is burnt by the catalyst, the catalyst deteriorates. To prevent this, in a certain prior art device, the purified gas at high temperature is partially released to the atmosphere without again passing through the heat reserve material. In such prior art device, the purified gas at high temperature is released to the atmosphere, and it hence requires preventive measures to prevent fires and expensive automatic high temperature valves.

In a different prior art device, when the temperature of the gas burnt by the catalyst of the objective gas becomes high, it cooled by sprinkling water. This prior art device is disclosed, for example, in Japanese Unexamined Patent Publication JPA 1-127811(1989). In this prior art device, the inorganic dissolved matter contained in the sprinkling water deposits on the catalyst and the heat reserve material in the form of scales, and continuous operation is difficult.

According to this embodiment, by using the regenerative catalytic combustion apparatus in which the gas is conducted by sequentially changing the direction of flow in the passages formed by the partition boards in the peripheral direction by means of the rotary distribution valve, the continuous operation for purification of the objective gas containing the organic solvent of malodorous substance is accomplished by executing the changeover action of the rotary distribution valve without moving the heat reserve material. Particularly in the invention, when the temperature of the space of the upper part above the plural passages is high, the changeover speed is lowered. Or, to the contrary, when the space temperature is low, the changeover speed is raised. Thus, the heat efficiency can be changed largely in accordance with the changeover speed, with the water equivalent ratio Wr/Wc at, for example, less than 5. Thus, continuous operation is possible for a long period without causing heat loss.

In particular, according to the above embodiment, when the temperature of the common D space of the upper part of the plural passages formed by partition boards is high, the changeover speed of the rotary distribution valve is lowered. Hence the ratio Wr/Wc of the water equivalent Wr of the heat reserve material to the water equivalent Wc of the objective gas is decreased, and the heat exchange is lowered. Therefore, the temperature in the common space is lowered. The temperature in the space is kept less than the heat resisting temperature of the catalyst 53 and pretreatment material 141, so that continuous operation is realized.

Therefore, according to the embodiment, if the organic solvent of high concentration is contained in the objective gas, purification of the objective gas is achieved without deterioration of the catalyst by heat.

Also according to the embodiment, by keeping the water equivalent ratio Wr/Wc less than about 5, it is possible, as clear from FIG. 19, to change the heat exchange efficiency of the heat reserve material largely in accordance with the changeover speed of the rotary distribution valve. Therefore if the concentration of the organic solvent contained in the objective gas changes in a wide range, the objective gas can be purified easily.

Further according to the embodiment, a heating device is provided in the common space. If the temperature is less than a predetermined first temperature, for example, 300° C., the heating device is operated to heat the objective gas to oxidize and burn the organic solvent. When the temperature exceeds the first temperature, the heating device is stopped, and the organic solvent contained in the objective gas is burnt by itself and purified. Further if the temperature is less than a predetermined second temperature, for example, 450° C. which is below the heat resisting temperature of the catalyst, for example, 550° C., the changeover speed of the rotary distribution valve is kept at a predetermined constant valve. When the temperature exceeds the second temperature, the changeover speed is lowered to a value less than the detection temperature in predetermined constant value as the detection temperature in the common space becomes higher, keeping less than the heat resisting temperature.

The heating device is operated when the temperature is below the predetermined first temperature, and the organic solvent is heated to be oxidized and decomposed. But when the temperature is above the first temperature, the heating means is stopped, and wasteful consumption of fuel or electric power is prevented. Thus, the elevation of the space temperature is suppressed. When the temperature is less than the second temperature which is below the heat resisting temperature of the catalyst exceeding the first temperature, the changeover speed of the rotary distribution valve is kept at a constant value. When the temperature is above the second temperature, as the detection temperature becomes higher, the changeover speed is lowered to the value less than the predetermined constant value, thus preventing the space temperature from reaching the heat resisting temperature of the catalyst. Thus, the deterioration of the catalyst 53 and pretreatment material 141 is prevented.

Moreover, according to the embodiment, if the concentration of the organic solvent contained in the objective gas varies in a wide range, or if an organic solvent of high concentration is contained, such objective gas can be adequately purified very easily.

Also according to the embodiment, by detecting the temperature-of such common space by temperature detecting means, and by controlling the changeover speed of the rotary distribution valve by the control means, automatic continuous operation is possible.

The oxidation recovery temperature and complete decomposition temperature of the malodorous substance contained in the objective gas supplied from the connection port 61 vary depending on the malodorous substance. In particular when the malodorous substance is acetic ester or tar, the temperature is high. Therefore, in order to decompose such malodorous substances by oxidizing, the temperature of the pretreatment material 141 and catalyst 54 contacting the objective gas is required to be 250° C. or more, preferably 300° C. or more.

The catalyst 54 and pretreatment material 141 heated by heat exchange with gas from the space 57 have heat exchange action. When the catalyst 54 and pretreatment material 141 have a greater heat exchange action as compared with the heat exchanger column 53, the temperature drop is larger in the catalyst 54 and pretreatment material 141. That is, the temperature difference (=th1−th3) between the temperature th1 in the upper part of the catalyst 54 and the temperature th3 in the lower part of the pretreatment material 141 becomes larger. Therefore, the temperature of the catalyst 54 and pretreatment material 141 is lowered too much. In addition, its action is lowered and the decomposition efficiency of the malodorous substance drops. Hence the removal action for removing the catalyst 54 deteriorating substances by pretreatment material 141 becomes insufficient.

There are many factors affecting the heat transfer in the regenerative combustion apparatus of the invention, but the principal factors are the water equivalent ratio Wr/Wc and the heating area of the heat exchanger column 54. To keep the catalyst 54 and pretreatment material 141 at 250° C. or more, or preferably 300° C. or more, as stated above, the heat transfer elements of the catalyst 54 and pretreatment material 141 must be decreased as much as possible. The heat transfer element of the heat exchanger column 53 must be increased as much as possible.

On the basis of the deodorizing performance of the catalyst 54 and the performance for removing the catalyst 54 deteriorating substances by the pretreatment material 141, a filling volume (in liters) over a specific value for the flow rate of the objective gas is determined by the space velocity (SV value) of the catalyst 54 and pretreatment material 141. This SV value depends on the shape of the base material for carrying the catalyst 54 as shown in Table 2.

$$SV\ \text{value} = \frac{\text{air flow per hour [m3/hr]}}{\text{volume of catalyst 54 [m3]}} \tag{7}$$

TABLE 2

| EMBODIMENT/ COMP. EXAMPLE | CATALYST TYPE OF BASE | CATALYST SV VALUE (× $10^4$) | CATALYST FILLING VOLUME (Liter) | CATALYST SPECIFIC HEAT | PRETREATMENT MATERIAL TYPE OF BASE | PRETREATMENT MATERIAL FILLING VOLUME (Liter) | PRETREATMENT MATERIAL SPECIFIC HEAT | PRETREATMENT MATERIAL SPECIFIC GRAVITY (kg/Liter) | PRETREATMENT MATERIAL HEAT CAPACITY (kcal/Liter) | WATER EQUIVALENT RATIO Wr/Wc |
|---|---|---|---|---|---|---|---|---|---|---|
| COMP. 1 | PELLET | 2 | 3.0 | 0.42 | CORRUGATE | 1.5 | 0.11 | 0.32 | 0.074 | 1.70 |
| EMB. 1 | HONEY-COMB | 4 | 1.5 | 0.21 | CORRUGATE | 1.5 | 0.11 | 0.32 | 0.074 | 1.03 |
| EMB. 2 | FOAMED METAL | 6 | 1.0 | 0.07 | CORRUGATE | 1.5 | 0.11 | 0.32 | 0.074 | 0.58 |
| COMP. 2 | PELLET | 2 | 3.0 | 0.42 | HONEYCOMB | 1.5 | 0.21 | 0.6 | 0.14 | 2.03 |
| COMP. 3 | HONEY-COMB | 4 | 1.5 | 0.21 | HONEYCOMB | 1.5 | 0.21 | 0.6 | 0.14 | 1.35 |
| EMB. 3 | FOAMED METAL | 6 | 1.0 | 0.07 | HONEYCOMB | 1.5 | 0.21 | 0.6 | 0.14 | 0.90 |

In Table 2 and Table 3 given below, Emb refers to embodiment and Comp represents comparative example.

Figure 20:
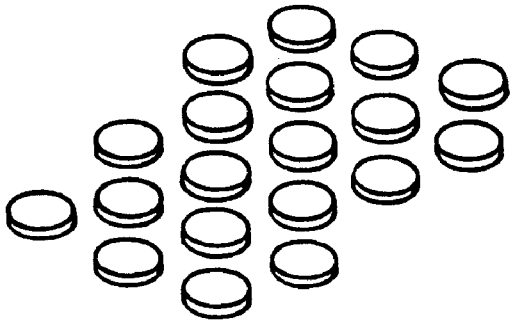
FIG. 20 is a perspective view showing the pellet shape, honeycomb shape, and foamed metal shape of the catalyst.
Figure 20:
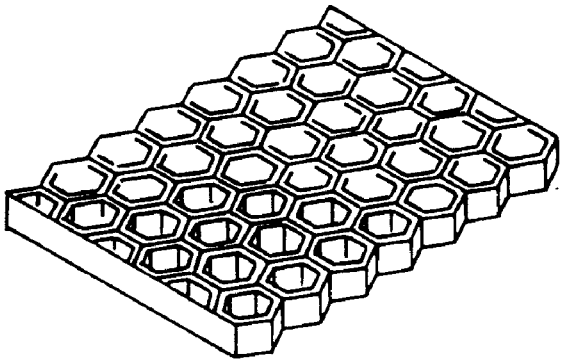
Figure 20:
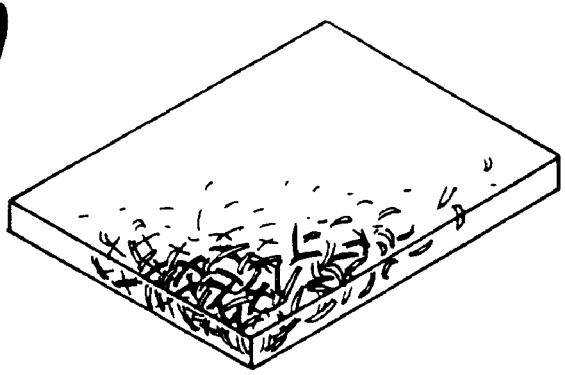

The shape of the pellets in Table 2 is granular as shown in FIG. 20 (1). The shape of the honeycomb is nearly hexagonal in the section of multiple passages through which gas flows as shown in FIG. 20 (2). The shape of the foamed metal is a porous shape made by combining multiple metal wire elements as shown in FIG. 20 (3), and the metal may be either iron or some other metal.

The catalysts which have larger SV values require a smaller filling volume, and hence the heat transfer action is smaller. It is advantageous because the temperature -drop is smaller when the purified gas from the space 57 passes through the catalyst 54 and pretreatment material 141. The catalyst 54 has a structure with a surface of base material composed of pellets, honeycomb or foamed metal is coated with platinum or palladium. The pellet shape and honeycomb shape structure of the catalyst 54 is, for example, composed of ceramic, and the honeycomb shape may be obtained by manufacturing by an extrusion molding.

The base material having the corrugated shape of the pretreatment material 141 is a structure of zigzag bent thin sheet of, for example, ceramic, and a flat plate of, for example, ceramic having fixed thickness. The honeycomb shape of the base material of the pretreatment material 141 may be manufactured, same as the honeycomb shape of the catalyst 54, by extrusion molding of, for example, ceramic, and it may be manufactured by molding a coordierite. The specific heat, specific gravity, and heat capacity of each shape of the pretreatment material 141 are as shown in Table 2. In Table 2, the changeover time of the regenerative combustion apparatus 50 is 30 sec. That is, each of the passages 84, 113 to 120 contacts with the objective gas for 30 sec., and then it contacts with the purified gas from the space 57 for 30 sec., and is finally changed over. Using a heat exchanger column 53 having 21 kg of Intalox Saddles (tradename), the inventor conducted an experiment at the water equivalent ratio Wr/Wc of 12 about the heat exchanger column 53, and the results are shown in Table 3.

TABLE 3

| SHAPE OF CATALYST | SHAPE OF PRETREATMENT MATERIAL | TEMPERATURE t57 | th1 | tc3 | tc1 | th2 | EMBODIMENT/ COMP. EXAMPLE |
|---|---|---|---|---|---|---|---|
| PELLET | CORRUGATE | 350 | 342 | 220 | 25 | 63 | COMP. 1 |
| | HONEYCOMB | 350 | 343 | 205 | 25 | 59 | COMP. 2 |
| HONEYCOMB | CORRUGATE | 350 | 348 | 262 | 25 | 48 | EMB. 1 |
| | HONEYCOMB | 350 | 348 | 228 | 25 | 46 | COMP. 3 |
| FOAMED METAL | CORRUGATE | 350 | 345 | 285 | 25 | 51 | EMB. 2 |
| | HONEYCOMB | 350 | 345 | 262 | 25 | 48 | EMB. 3 |

In Table 3, temperature ts7 refers to the temperature in the space 57. An electric heater is used as the heating device in this embodiment, and the temperature ts7 is kept at 350° C. According to the experiment, when the objective gas is supplied, in embodiment 1, embodiment 2, and embodiment 3, temperature tc3 in the lower part of the pretreatment material 141 was kept at 250° C. or more and the action of the pretreatment material 141 and catalyst 54 was sufficient, whereas the temperature tc3 was less than 250° C. in comparative examples 1, 2 and 3. That is, in embodiment 1, the catalyst 54 has a shape of the honeycomb base material, and the heat capacity of the pretreatment material 141 is about less than 0.1 kcal/° C.-liter as evident from Table 2. In addition, this pretreatment material 141 has a base material of corrugated shape. When the shape of the catalyst 54 is foamed metal, whether the pretreatment material 141 is in corrugated shape or honeycomb shape the temperature tc3 could be kept at 250° C. or more.

Figure 21:
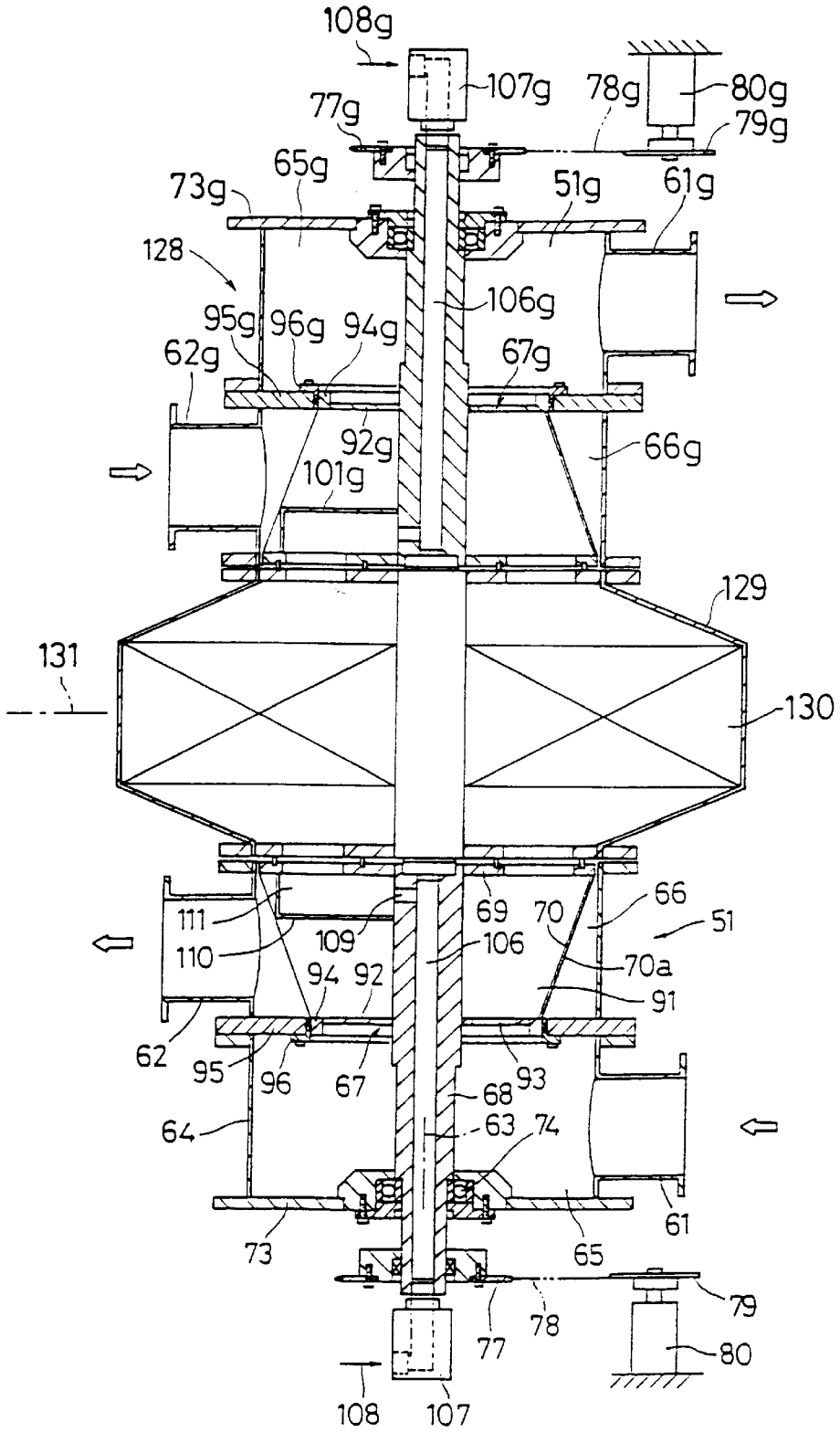
FIG. 21 is a simplified sectional view of a regenerative heat exchanger of yet another embodiment of the invention.
Figure 22:
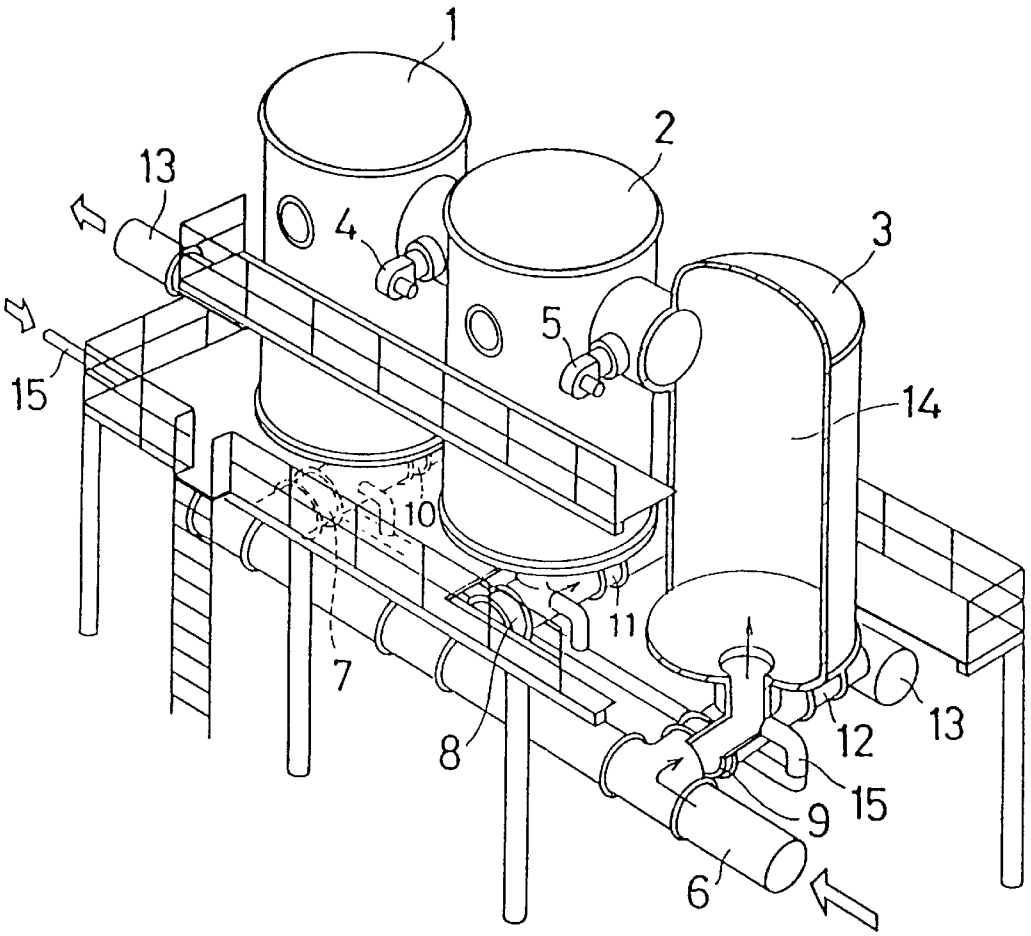
Fig. 22 PRIOR ART
FIG. 22 is a partially cut-away perspective view of a prior art device.
Figure 23:
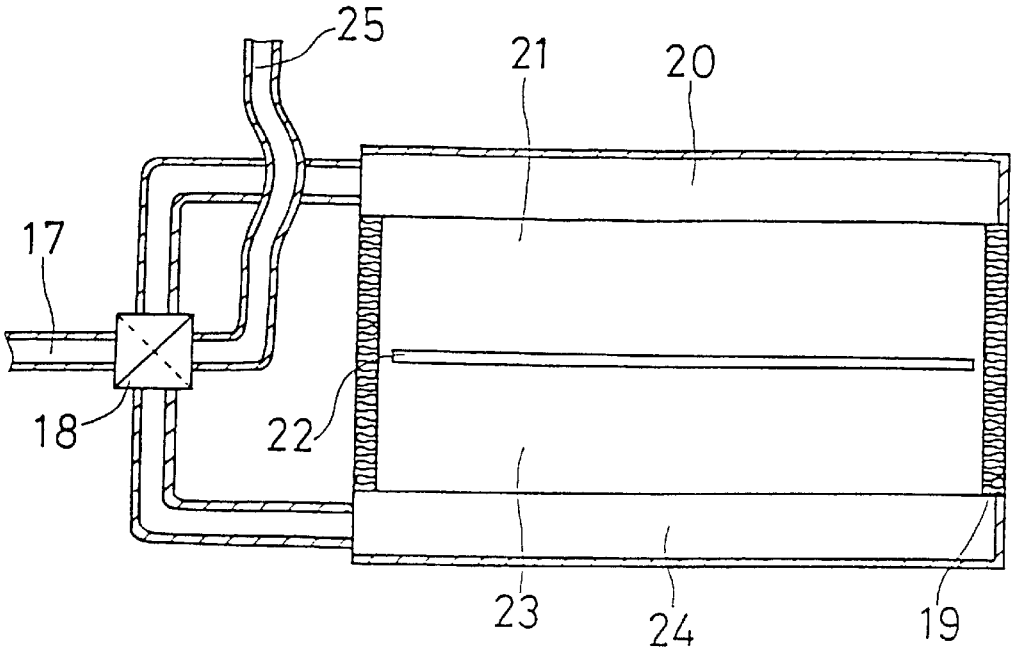
Fig. 23 PRIOR ART
FIG. 23 is a sectional view of other prior art device.
Figure 24:
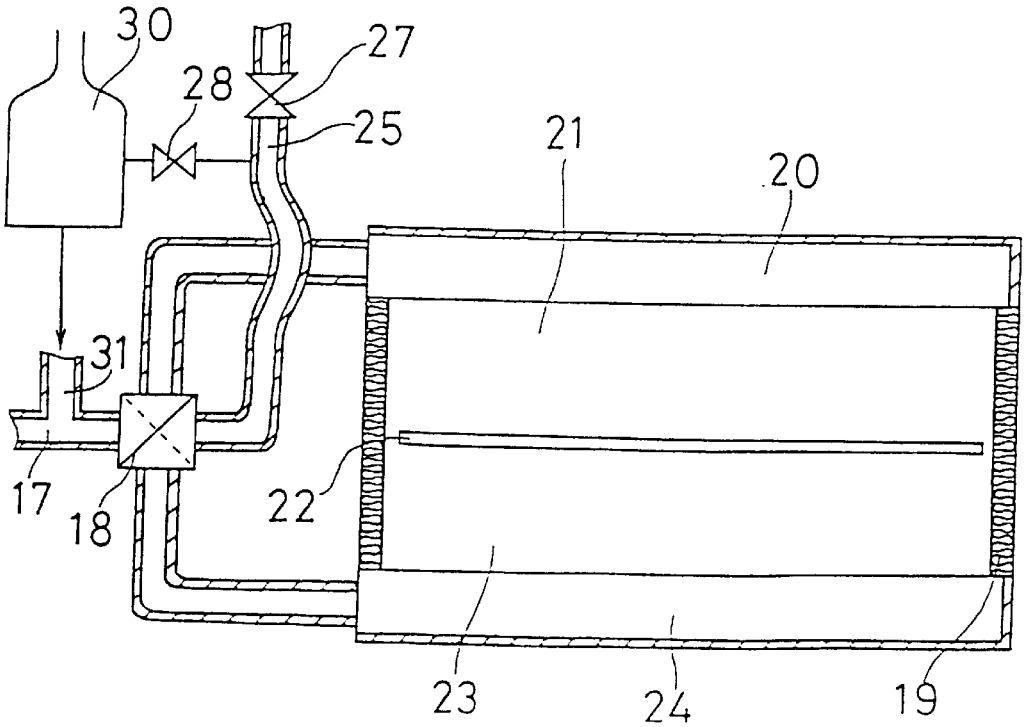
Fig. 24 PRIOR ART
FIG. 24 is a sectional view showing a different prior art device modified from the prior art device shown in FIG. 23.

FIG. 21 is a simplified sectional view of a regenerative heat exchanger 128 of a different embodiment of the invention. Beneath a housing 129 accommodating a heat exchanger column, a rotary distribution valve 51 is provided. A second rotary distribution valve 51*g* inverted or upside down is disposed above the housing 129 so as to be positioned symmetrically with respect to a horizontal plane of symmetry 131. The parts of the rotary distribution valve S1*g* corresponding to those of the rotary distribution valve 51 are indicated by adding a suffix g to the same reference numerals. The high temperature gas is supplied from a duct 61. The gas is conducted into the housing 129 to heat a heat exchanger column (heat reserve material) 130 to accumulate heat, and is discharged from a connection port 61*g*. Valve discs 67, 67*g* cooperate in synchronism, and are integrally rotated and driven by motors 80, 80*g*. From a connection port 62*g*, the gas to be heated is supplied, and is heated by the heat exchanger column 130 in which heat is accumulated. The gas is then discharged from a connection port 62. Thus, high temperature gas and low temperature gas flow countercurrently and exchange their heat through the heat exchanger column 130. The housing 129 is partitioned at equal intervals in the peripheral direction by the partition boards the same as in the foregoing embodiments, and the other features are the same as in the foregoing embodiments. The shaft holes 106, 106*g*, auxiliary partition walls 110, 110*g*, and rotary tube joints 107, 107*g* may be omitted.

The invention is applied not only in the regenerative catalytic combustion apparatus and regenerative heat exchanger, but also in other uses in a wide range.

In the embodiments shown in FIG. 1 through FIG. 20, the catalyst 54 and pretreatment material 141 may be omitted. In other embodiments, only the pretreatment material 141 ma be omitted.

The flow directions of the objective gas and clean gas may be opposite to the directions as shown in the above embodiments.

TECHNICAL APPLICABILITY

Thus, according to the invention, the fluid passing through the pair of chambers formed in the valve box may be continuously changed over and may flow into the passage of each stationary valve port formed by the passage forming devices including the partition boards at the stationary valve member side.

Especially, according to the invention, the third moving valve port is formed at one side between the first and second moving valve ports along the peripheral direction. Hence undesired mixing of gas between the first and second moving valve ports can be prevented by purging gas or the like.

Further, according to the invention, at the other side between the first and second moving valve ports along the peripheral direction, the changeover part 138 extending in the peripheral direction so as to close at least one stationary valve port is provided in the valve disc. Hence fluid such as gas is smoothly changed over in the passage of each stationary valve port respectively communicating with the first and second moving valve ports, so that the fluid can be passed in all passages, and the operation efficiency is excellent.

Another excellent effect of the invention is that the sealing between of the moving valve member and stationary valve member can be composed easily.

By realizing the regenerative combustion apparatus by using such rotary distribution valve, the fluid such as objective gas containing malodorous substances can be operated continuously by rotating and driving the valve disk of the rotary distribution valve without moving the heat reserve material. Hence, all advantage of the rotary type regenerative combustion apparatus can be exhibited, that is, the purging area is essentially minimized, the structure may be reduced in size, and the heat reserve material is substantially decreased, which also contributes to reduction of the structural size.

Also according to the invention, the structure of the rotary distribution valve is simple, the high temperature gas does not pass away, and adverse effects of thermal distortion can be eliminated.

In the invention, it is not necessary to rotate and drive a heavy heat exchanger column, but only a light valve disc may be rotated and driven, and the structure is simplified and reduced in size. Hence the facility cost can be saved. The same effects are obtained when the rotary distribution valve is applied in the regenerative heat exchanger.

According to the invention, moreover, the temperature of the catalyst and the pretreatment material for removing the catalyst deteriorating substances is prevented from becoming too low, so that the action of the catalyst and the pretreatment material may be exhibited sufficiently.

Further according to the invention, communicating holes consisting of a porous plate having multiple pores opposite to the space in which the heating device is provided are formed. Hence the gas is mixed sufficiently in the space, and uniform temperature distribution is achieved. Thus a purified gas having uniform temperature is conducted into the catalyst, pretreatment material, and heat exchanger column, and the heat is accumulated.

In the invention, since the purging gas can pass only through one of the passages 84, 113 to 120 partitioned by the partition boards 55 in the housing 52, the remaining passages 84, 113 to 120 can be used effectively for passing the objective gas or passing the purified gas. The effective volume of the heat reserve material, catalyst, and pretreatment material can be increased. Hence the efficiency is high. Moreover, since the purging gas is supplied into one of the passages 84, 113 to 120, the structure of the rotary distribution valve 51 can be simplified. Furthermore, since the purging gas is supplied only in one of the passages 84, 113 to 120, the required flow rate of purging gas can be reduced. In addition, this purging gas is, for example, a clean air at ordinary temperature, and by allowing the purging gas to pass only in one of the passages 84, 113 to 120, it is possible to minimize undesired cooling of the heat exchanger column 53 and hence drop of temperature.

What is claimed is:

1. A rotary distribution valve comprising:

a passage forming structure having an axis, a plurality of passages formed therein, and a plurality of stationary valve ports which are positioned at intervals in a peripheral direction around said axis, each stationary valve port being connected to one of said passages; and a valve box coaxially aligned with and connected to an end of said passage forming structure, said valve box having provided therein a valve disc rotatably provided on said axis, a first chamber and a second chamber, each of said first and said second chambers having a connection port and being coaxially aligned with said valve disc, said valve disc comprising a first set and a second set of moving valve ports formed in a peripheral direction about said axis adjacent said second chamber at an end of said valve box, a third moving valve port located between said first set and said second set of moving valve ports, and a changeover part located between said first set and said second set of moving valve ports opposite said third moving valve port sized to prevent fluid from flowing through one of said stationary valve ports, said second chamber further comprising a guide space delimited therein by a plurality of partition walls which connect said first chamber with said first set of moving valve ports and said second chamber with said second set of moving valve ports, and a communicating passage connected with said third moving valve port formed by an auxiliary partition wall.

2. The rotary distribution valve of claim 1, wherein:

said valve disc further comprises a rotary shaft rotatably provided on said axis, and a moving valve member fixed to said rotary shaft at said end of said valve box, said moving valve member having formed therein said first set and said second set of moving valve ports, and said third moving valve port; and said passage forming structure further comprises a stationary valve member which is fixed to said valve box adjacent said moving valve member and has said plurality of stationary valve ports formed therein, and a plurality of partitions connected to said plurality of stationary valve ports thereby forming said plurality of passages.

3. The rotary distribution valve of claim 1, further comprising:

a rotary shaft rotatably provided on said axis in said valve disc, said rotary shaft having a shaft hole connecting said communicating passage to said rotary shaft; and a rotary tube joint connected to said shaft hole.

4. The rotary distribution valve of claim 1, wherein:

said passage forming structure further comprises a stationary valve member; and said valve disc further comprises a moving valve member positioned perpendicular to said axis, said moving valve member having formed therein said first set and said second set of moving valve ports, said third moving valve port, said changeover part, and a plurality of seal members in contact with said stationary valve member and extending in a radial direction between said first set of moving valve ports and said second set of moving valve ports, said third moving valve port and said first set of moving valve ports, and said third moving valve port and said second set of moving valve ports.

5. The rotary distribution valve of claim 4, further comprising:

a first angle defined as an angle between said seal members adjacent said third moving valve port;

a plurality of second angles defined as an angle between radially extending edges of said stationary valve ports;

a plurality of third angles defined as an angle between radially extending edges of adjacent stationary valve ports;

wherein:

a sum of said second angle and said third angle is equal to or greater than said first angle;

said first angle is equal to or greater than said second angle; and said third angle is equal to or greater than said second angle.

6. The rotary distribution valve of claim 5, wherein:

said third angle is greater than said second angle.

7. The rotary distribution valve of claim 5, further comprising:

a pair of auxiliary seal members mounted to said moving valve member in contact with said stationary valve member and extending in a radial direction between said third moving valve port and said first set of moving valve ports, and said third moving valve port and said second set of moving valve ports;

a sixth angle defined as an angle between said auxiliary seal members; and wherein a sum of twice said third angle and said second angle is equal to or greater than said sixth angle, and said sixth angle is greater than or equal to said second angle.

8. The rotary distribution valve of claim 5, further comprising:

a fourth angle defined as an angle between said seal members extending between said first set of moving valve ports and said second set of moving valve ports; and wherein said fourth angle is approximately equal to said second angle.

9. A regenerative combustion apparatus comprising:

a housing having provided therein an axis, a heat exchanger column, a catalyst provided in said heat exchanger column to burn an objective gas, partitions extending vertically in said housing at intervals in a peripheral direction to partition said heat exchanger column and said catalyst thereby forming a plurality of passages, and a common space located in an upper part of said housing and in communication with said plurality of passages;

a rotary distribution valve located beneath said housing comprising a valve box coaxially aligned with and connected to an end of said housing, said valve box having provided therein a stationary valve member connected to said housing, a plurality of stationary valve ports which are positioned in intervals in a peripheral direction around said axis so that each stationary valve port is connected to one of said passages, a valve disc rotatably provided on said axis, a first chamber and a second chamber, each of said first and said second chambers having a connection port and being coaxially aligned with said valve disc, said valve disc comprising a first set and a second set of moving valve ports formed in a peripheral direction about said axis adjacent said second chamber at an end of said valve box, a third moving valve port located between said first set and said second set of moving valve ports, and a changeover part located between said first set and said second set of moving valve ports opposite said third moving valve port sized to prevent flow through one of said stationary valve ports, said second chamber further comprising a guide space delimited therein by a plurality of partition walls which connect said first chamber with said first set of moving valve ports and said second chamber with said second set of moving valve ports, and a communicating passage connected with said third moving valve port formed by an auxiliary partition wall;

wherein the objective gas is supplied into one of said first and said second chambers and a purified gas is conducted from the other of said first and said second chambers;

wherein a clean purging gas is supplied into said communicating passage in a same flow direction as the objective gas; and wherein said valve disc is rotatable to purge objective gas from said plurality of passages by using the clean purging gas to change a direction of flow in said plurality of passages.

10. The regenerative combustion apparatus of claim 9, further comprising:

a rotation drive source to rotate said valve disc; and wherein said plurality of passages comprises eight passages.

11. The regenerative combustion apparatus of claim 9, wherein:

a pretreatment material is interposed between said heat exchanger column and said catalyst to remove any catalyst deteriorating substances contained in the objective gas; and wherein said catalyst is composed mainly of a foamed metal material and is combined with said pretreatment material.

12. The regenerative combustion apparatus of claim 9, further comprising:

a heating device provided in said upper part of said housing;

a space partition wall provided in said upper part of said housing to form said common space; and a porous plate mounted to said space partition wall having multiple discrete pores to form communicating holes which are located at a clearance above said catalyst thereby connecting said plurality of passages with said common space.

13. The regenerative combustion apparatus of claim 12, wherein:

said heating device is adapted to heat a pretreatment material to a temperature of 250 degrees C. or greater.

14. The regenerative combustion apparatus of claim 12, further comprising:

a pretreatment material having a specific heat of about 0.1 kcal/° C. or less is interposed between said heat exchanger column and said catalyst to remove any catalyst deteriorating substances contained in the objective gas; and wherein said catalyst is composed mainly of a base of honeycomb material.

15. The regenerative combustion apparatus of claim 14, wherein:

said pretreatment material is composed of a corrugated base.

16. The regenerative combustion apparatus of claim 9, wherein:

said valve disc further comprises a rotary shaft rotatably provided on said axis, and a moving valve member fixed to said rotary shaft at said end of said valve box, said moving valve member having formed therein said first set and said second set of moving valve ports, and said third moving valve port; and said stationary valve member is fixed to said valve box adjacent said moving valve member and has said plurality of stationary valve ports formed therein such that said plurality of partitions are connected to said plurality of stationary valve ports to form said plurality of passages.

17. The regenerative combustion apparatus of claim 9, further comprising:

a rotary shaft rotatably provided on said axis in said valve disc, said rotary shaft having a shaft hole connecting said communicating passage to said rotary shaft; and a rotary tube joint connected to said shaft hole.

18. The regenerative combustion apparatus of claim 9, wherein:

said valve disc further comprises a moving valve member positioned perpendicular to said axis, said moving valve member having formed therein said first set and said second set of moving valve ports, said third moving valve port, said changeover part, and a plurality of seal members in contact with said stationary valve member and extending in a radial direction between said first set of moving valve ports and said second set of moving valve ports, said third moving valve port and said first set of moving valve ports, and said third moving valve port and said second set of moving valve ports.

19. The regenerative combustion apparatus of claim 18, further comprising:

a first angle defined as an angle between said seal members adjacent said third moving valve port;

a plurality of second angles defined as an angle between radially extending edges of said stationary valve ports;

a plurality of third angles defined as an angle between radially extending edges of adjacent stationary valve ports;

wherein:

a sum of said second angle and said third angle is equal to or greater than said first angle;

said first angle is equal to or greater than said second angle; and said third angle is equal to or greater than said second angle.

20. The regenerative combustion apparatus of claim 19, wherein:

said third angle is greater than said second angle.

21. The regenerative combustion apparatus of claim 19, further comprising:

a pair of auxiliary seal members mounted to said moving valve member in contact with said stationary valve member and extending in a radial direction between said third moving valve port and said first set of moving valve ports, and said third moving valve port and said second set of moving valve ports;

a sixth angle defined as an angle between said auxiliary seal members; and wherein a sum of twice said third angle and said second angle is equal to or greater than said sixth angle, and said sixth angle is greater than or equal to said second angle.

22. The regenerative combustion apparatus of claim 19, further comprising:

a fourth angle defined as an angle between said seal members extending between said first set of moving valve ports and said second set of moving valve ports; and wherein said fourth angle is approximately equal to said second angle.

23. A method of operating a regenerative combustion apparatus having:

a housing having provided therein an axis, a heat exchanger column, a catalyst provided in the heat exchanger column to burn an objective gas, partitions extending vertically in the housing at intervals in a peripheral direction to partition the heat exchanger column and the catalyst thereby forming a plurality of passages, a heating device located in an upper part of the housing; a space partition wall provided in the upper part of the housing thereby forming a common space; and a porous plate mounted to the space partition wall having multiple discrete pores to form communication holes which are located at a clearance above the catalyst thereby connecting the plurality of passages with the common space;

a rotary distribution valve located beneath the housing comprising a valve box coaxially aligned with and connected to an end of the housing, the valve box having provided therein a stationary valve member connected to the housing, a plurality of stationary valve ports which are positioned at intervals in a peripheral direction around the axis so that each stationary valve port is connected to one of the passages, a valve disc rotatably provided on the axis, a first chamber and a second chamber, each of the first and the second chambers having a connection port and being coaxially aligned with the valve disc, the valve disc comprising a first set and a second set of moving valve ports formed in a peripheral direction about the axis adjacent the second chamber at an end of the valve box, a third moving valve port located between the first set and the second set of moving valve ports, and a changeover part located between the first set and the second set of moving valve ports opposite the third moving valve port sized to prevent flow through one of the stationary valve ports, the second chamber further comprising a guide space delimited therein by a plurality of partition walls which connect the first chamber with the first set of moving valve ports and said second chamber with the second set of moving valve ports, and a communicating passage connected with the third moving valve port formed by an auxiliary partition wall;

the method comprising:

supplying the objective gas into one of the first and the second chambers;

passing the objective gas through the communicating holes at about 5–20 m/sec;

conducting a purified gas from the other of the first and the second chambers;

supplying a clean purging gas into the communicating passage in a same flow direction as the objective gas; and rotating the valve disc to purge objective gas from the plurality of passages by using the clean purging gas to change a direction of flow in the plurality of passages.

24. A regenerative heat exchanger comprising:

a housing having provided therein an axis, a heat exchanger column, partitions extending vertically in said housing at intervals in a peripheral direction to partition said heat exchanger column thereby forming a plurality of passages;

first and second rotary distribution valves located respectively above and beneath said housing, each of said first and said second rotary distribution valves comprising a valve box coaxially aligned with and connected to an end of said housing, each said valve box having provided therein a stationary valve member connected to said housing, a plurality of stationary valve ports which are positioned at intervals in a peripheral direction around said axis so that each stationary valve port is connected to one of said passages, a valve disc rotatably provided on said axis, a first chamber and a second chamber, each of said first and said second chambers having a connection port and being coaxially aligned with said valve disc, said valve disc comprising a rotary shaft, a first set and a second set of moving valve ports formed in a peripheral direction about said axis adjacent said second chamber at an end of said valve box, a third moving valve port located between said first set and said second set of moving valve ports, and a changeover part located between said first set and said second set of moving valve ports opposite said third moving valve port sized to prevent flow through one of said stationary valve ports, said second chamber further comprising a guide space delimited therein by a plurality of partition walls which connect said first chamber with said first set of moving valve ports and said second chamber with said second set of moving valve ports, and a communicating passage connected with said third moving valve port formed by an auxiliary partition wall;

wherein said rotary shafts are driven in cooperation;

wherein a high temperature gas is supplied into one of said first and said second chambers of said first rotary distribution valve, through said heat exchanger column, and conducted into a corresponding one of said first and said second chambers of said second rotary distribution valve; and wherein a low temperature gas is supplied into the other of said first and said second chambers of said first rotary distribution valve, through said heat exchanger column, and conducted into the other of said first and said second chambers of said second rotary distribution valve.

25. A rotary distribution valve comprising:

a valve box having an axis and first and second chambers, each of said first and said second chambers having a connection port;

a stationary valve member located at an end of said valve box and having a plurality of stationary valve ports positioned at intervals in a peripheral direction around said axis;

a valve disc interposed between said valve box and said stationary valve member and rotatably provided on said axis, said valve disc having a first set and a second set of moving valve ports formed in the peripheral direction about said axis adjacent said second chamber, a third moving valve port located between said first set and said second set of moving valve ports, a changeover part located between said first set and said second set of moving valve ports opposite said third moving valve port sized to prevent fluid from flowing through one of said stationary valve ports;

a plurality of partition walls which delimit a guide space from said second chamber such that said first chamber is connected to said first set of moving valve ports and said second chamber is connected to said second set of moving valve ports; and an auxiliary partition wall which forms a communicating passage connected to said third moving valve port.

26. The rotary distribution valve of claim 25, wherein:

said valve disc further comprises a rotary shaft rotatably provided on said axis, and a moving valve member fixed to said rotary shaft at said end of said valve box, said moving valve member having formed therein said first set and said second set of moving valve ports, said third moving valve port, and said changeover part.

27. The rotary distribution valve of claim 25, further comprising:

a rotary shaft rotatably provided on said axis in said valve disc, said rotary shaft having a shaft hole connecting said communicating passage to said rotary shaft; and a rotary tube joint connected to said shaft hole.

28. The rotary distribution valve of claim 25, wherein:

said valve disc further comprises a moving valve member positioned perpendicular to said axis, said moving valve member having formed therein said first set and said second set of moving valve ports, said third moving valve port, said changeover part, and a plurality of seal members in contact with said stationary valve member and extending in a radial direction between said first set of moving valve ports and said second set of moving valve ports, said third moving valve port and said first set of moving valve ports, and said third moving valve port and said second set of moving valve ports.

29. The rotary distribution valve of claim 28, further comprising:

a first angle defined as an angle between said seal members adjacent said third moving valve port;

a plurality of second angles defined as an angle between radially extending edges of said stationary valve ports;

a plurality of third angles defined as an angle between radially extending edges of adjacent stationary valve ports;

wherein:

a sum of said second angle and said third angle is equal to or greater than said first angle;

said first angle is equal to or greater than said second angle; and said third angle is equal to or greater than said second angle.

30. The rotary distribution valve of claim 29, wherein:

said third angle is greater than said second angle.

31. The rotary distribution valve of claim 29, further comprising:

a pair of auxiliary seal members mounted to said moving valve member in contact with said stationary valve member and extending in a radial direction between said third moving valve port and said first set of moving valve ports, and said third moving valve port and said second set of moving valve ports;

a sixth angle defined as an angle between said auxiliary seal members; and wherein a sum of twice said third angle and said second angle is equal to or greater than said sixth angle, and said sixth angle is greater than or equal to said second angle.

32. The rotary distribution valve of claim 29, further comprising:

a fourth angle defined as an angle between said seal members extending between said first set of moving valve ports and said second set of moving valve ports; and wherein said fourth angle is approximately equal to said second angle.

* * * * *